US010973289B2

(12) United States Patent
Cowgill et al.

(10) Patent No.: US 10,973,289 B2
(45) Date of Patent: Apr. 13, 2021

(54) UMBRELLA ACCESSORIES AND ADAPTERS THEREOF

(71) Applicants: William S. Cowgill, Ventura, CA (US); Crystal D. Cowgill, Ventura, CA (US)

(72) Inventors: William S. Cowgill, Ventura, CA (US); Crystal D. Cowgill, Ventura, CA (US)

( * ) Notice: Subject to any disclaimer, the term of this patent is extended or adjusted under 35 U.S.C. 154(b) by 0 days.

(21) Appl. No.: 16/512,203

(22) Filed: Jul. 15, 2019

(65) Prior Publication Data

US 2020/0018087 A1 Jan. 16, 2020

Related U.S. Application Data

(60) Provisional application No. 62/698,535, filed on Jul. 16, 2018.

(51) Int. Cl.
*A45B 25/10* (2006.01)
*A45B 25/00* (2006.01)

(52) U.S. Cl.
CPC ..... *A45B 25/10* (2013.01); *A45B 2025/003* (2013.01); *A45B 2200/1009* (2013.01)

(58) Field of Classification Search
CPC ..... A45B 25/10; A45B 2025/003; A45B 2200/1009
USPC ..... 135/16, 28, 96; 248/540
See application file for complete search history.

(56) References Cited

U.S. PATENT DOCUMENTS 462,171 A * 10/1891 Smith ..... A45B 25/06 135/28
3,286,962 A 11/1966 Warth
4,505,285 A * 3/1985 French ..... A45B 3/00 135/16
4,542,757 A 9/1985 Phillips
4,788,996 A * 12/1988 Forshee ..... A45B 11/00 135/16
4,790,338 A * 12/1988 Strobl ..... A45B 3/00 135/16
4,962,779 A * 10/1990 Meng ..... A45B 3/00 135/16
5,161,561 A * 11/1992 Jamieson ..... A45B 3/00 108/94
5,261,434 A * 11/1993 Fodero ..... A45B 3/00 135/16

(Continued)

FOREIGN PATENT DOCUMENTS

DE 3821285 A1 12/1989
FR 2872391 A1 1/2006

*Primary Examiner* — Noah Chandler Hawk
(74) *Attorney, Agent, or Firm* — Zilka-Kotab, P.C.

(57) ABSTRACT

A system includes a topper support having a first end and a second end opposite the first end. The first end of the topper support is configured for operative coupling to an upper end of an umbrella. The second end is positioned above the upper end of the umbrella when the first end is coupled to the upper end of the umbrella. The second end of the topper support is configured for operative coupling to an accessory topper. A system includes an umbrella, an accessory topper, and a topper support. The topper support is configured for operatively coupling the accessory topper to the umbrella. A system includes an umbrella, an accessory topper, and an adapter. The adapter is configured for operatively coupling the accessory topper to the umbrella. A system includes an umbrella having an accessory topper as a permanent component of the umbrella.

37 Claims, 18 Drawing Sheets

(56) References Cited

U.S. PATENT DOCUMENTS

| | | | | |
|---|---|---|---|---|
| 5,273,062 | A | 12/1993 | Mozdzanowski | |
| 5,964,439 | A * | 10/1999 | Johnson | A61G 5/10 248/278.1 |
| 6,083,114 | A | 7/2000 | Bailey | |
| 9,038,298 | B2 | 5/2015 | Bacik | |
| 9,245,466 | B2 * | 1/2016 | Bacik | G09F 23/00 |
| 2007/0113380 | A1 | 5/2007 | Lee et al. | |
| 2017/0112243 | A1 * | 4/2017 | Letendre | A45B 25/08 |

* cited by examiner

UMBRELLA ACCESSORIES AND ADAPTERS THEREOF

RELATED APPLICATIONS

This application claims priority to U.S. Provisional Patent Application No. 62/698,535 filed Jul. 16, 2018, which is herein incorporated by reference.

FIELD OF THE INVENTION

The present invention relates to umbrellas and outdoor shading, and more particularly, this invention relates to accessories and adapters for umbrellas.

BACKGROUND

Outdoor entertainment is often impeded by weather conditions, sun, rain, wind, insects, animals, etc. Relatively large umbrellas may be used for shielding and/or shading from the aforementioned impediments. It may be difficult to distinguish and/or identify individual umbrellas. For example, a plurality of beach umbrellas may be found on a beach which are used to provide areas of shade. It may be difficult to ascertain which umbrella belongs to an individual if the plurality of umbrellas appear to be substantially similar.

In many situations, umbrellas are preferably portable and easy to disassemble/assemble. For example, a beach umbrella is preferably capable of efficient transfer from the beach to a vehicle and vice versa.

SUMMARY

A system, according to one general embodiment, includes a topper support having a first end and a second end opposite the first end. The first end of the topper support is configured for operative coupling to an upper end of an umbrella. The second end is positioned above the upper end of the umbrella when the first end is coupled to the upper end of the umbrella. The second end of the topper support is configured for operative coupling to an accessory topper.

A system, according to another general embodiment, includes a topper support having a first end and a second end opposite the first end; and an adapter having a top portion and a bottom portion opposite the top portion. The top portion is positioned above the bottom portion when the top portion is coupled to the topper support. The bottom portion of the adapter is configured for operative coupling to an upper end of an umbrella and the first end of the topper support is configured for operative coupling to the top portion of the adapter. The second end of the topper support is configured for operative coupling to an accessory topper.

A system, according to yet another general embodiment, includes an umbrella, an accessory topper, and a topper support. The topper support is configured for operatively coupling the accessory topper to the umbrella.

A system, according to yet another general embodiment, an umbrella, an accessory topper, and an adapter. The adapter is configured for operatively coupling the accessory topper to the umbrella.

A system, according to one general embodiment includes a topper support and/or adapter integrated as a permanent component of the accessory topper and/or the umbrella.

A system, according to one general embodiment includes an umbrella having an accessory topper as a permanent component of the umbrella.

Other aspects and advantages of the present invention will become apparent from the following detailed description, which, when taken in conjunction with the drawings, illustrate by way of example the principles of the invention.

BRIEF DESCRIPTION OF THE DRAWINGS

FIG. 15D is a cross-sectional side view of an adapter base, according to one embodiment.

DETAILED DESCRIPTION

Figure 1:
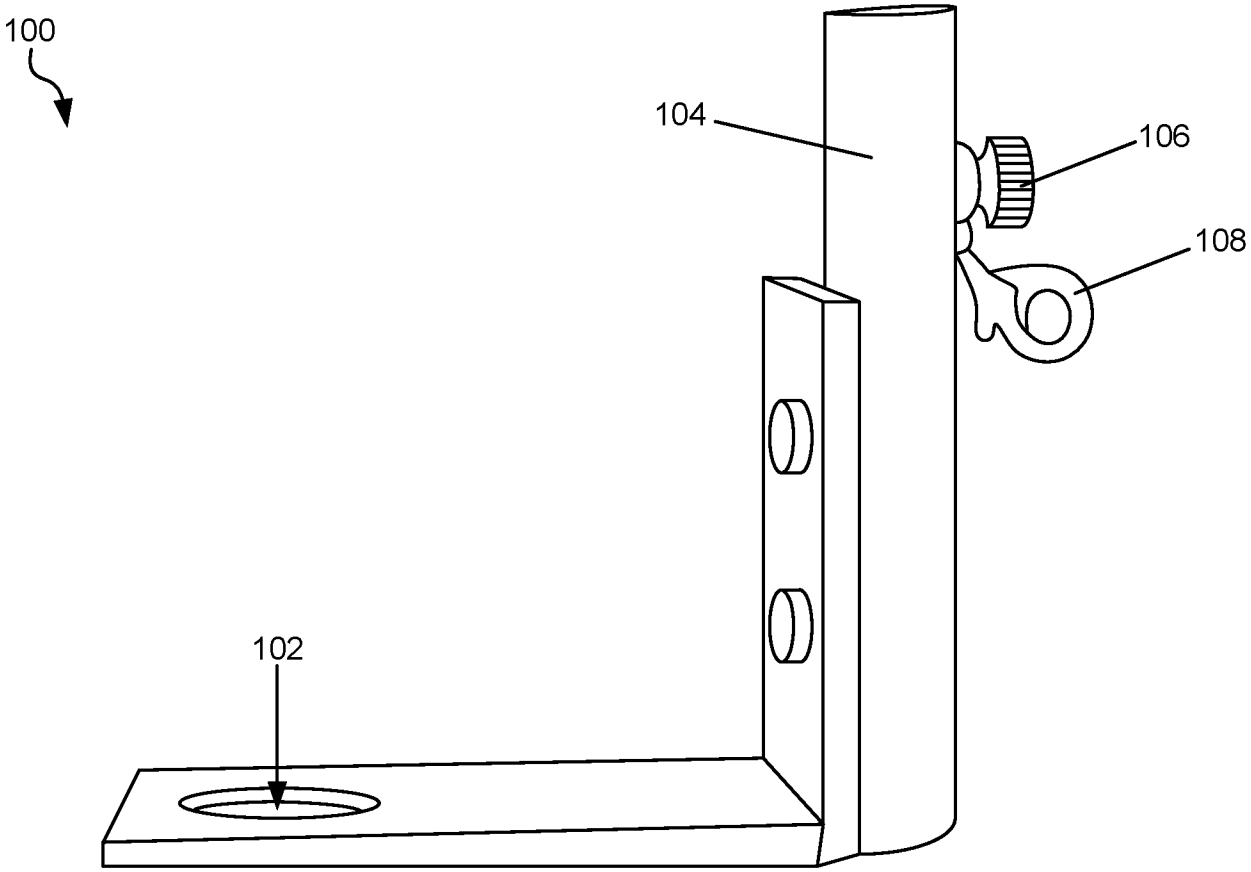
FIG. 1 is an accessory universal mounting bracket affixing device, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of umbrella accessories and adapters thereof and/or related systems and methods.

In one general embodiment, a system includes a topper support having a first end and a second end opposite the first end. The first end of the topper support is configured for operative coupling to an upper end of an umbrella. The second end is positioned above the upper end of the umbrella when the first end is coupled to the upper end of the umbrella. The second end of the topper support is configured for operative coupling to an accessory topper.

In another general embodiment, a system includes a topper support having a first end and a second end opposite the first end; and an adapter having a top portion and a bottom portion opposite the top portion. The top portion is positioned above the bottom portion when the top portion is coupled to the topper support. The bottom portion of the adapter is configured for operative coupling to an upper end of an umbrella and the first end of the topper support is configured for operative coupling to the top portion of the adapter. The second end of the topper support is configured for operative coupling to an accessory topper.

In yet another general embodiment, a system includes an umbrella, an accessory topper, and a topper support. The topper support is configured for operatively coupling the accessory topper to the umbrella.

In another embodiment, a system includes an umbrella, an accessory topper, and an adapter. The adapter is configured for operatively coupling the accessory topper to the umbrella.

In one general embodiment, a system includes an umbrella having an accessory topper as a permanent component of the umbrella.

A system, according to one general embodiment includes any fastening mechanism integrated as a permanent component of the accessory topper and/or the umbrella.

In one general embodiment, a system includes an umbrella having an accessory topper as a permanent component of the umbrella.

Outdoor entertainment is often impeded by weather conditions, sun, rain, wind, insects, animals, etc. Relatively large umbrellas may be used for shielding and/or shading from the aforementioned impediments. It may be difficult to distinguish and/or identify individual umbrellas. For example, a plurality of beach umbrellas may be found on a beach which are used to provide areas of shade. It may be difficult to ascertain which umbrella belongs to an individual if the plurality of umbrellas appear to be substantially similar.

In stark contrast, many embodiments of the present invention provide any known umbrella with an efficient and/or reliable differentiation from other similar umbrellas in a variety of environments, including beaches, parks, hotels, restaurants, campgrounds, etc. Various embodiments of the present invention provide entertaining and/or visual appealing accessories (and/or supports and/or adapters thereof) for any umbrella known in the art.

Various known umbrellas may be cumbersome to assemble, dissemble, and/or transport. Relatively large umbrellas are preferably easy to dissemble and pack away into a vehicle after use. The height of a portable umbrella is often limited by the vehicle for transporting the umbrella from location to location.

In stark contrast, various embodiments disclosed herein provide detachable topper supports, adapters, and/or accessory toppers which are relatively quick to assemble, dissemble, and/or transport. In other embodiments, the topper supports, adapters, and/or accessory toppers may be integrated as a permanent component of any known umbrella. In yet other embodiments, the topper supports, adapters, accessory toppers and/or umbrellas comprise permanently integrated fastening mechanisms for detachably coupling an accessory topper to any umbrella known in the art.

Various embodiments of the present invention provide accessory topper supports and/or adapters which may be used in any combination to combine, position and/or secure one or more accessory toppers to umbrellas as would be understood by one having ordinary skill in the art upon reading the present disclosure. Accessory toppers may comprise any variety of accessory toppers including windsocks, solar light globes, balloons, flags, kites, pinwheels, bird deterrents, character figurines, sports figurines, weathervanes, wind spinners, etc. Any accessory topper may be a conventionally manufactured accessory topper which may be used and/or permanently integrated in conjunction with any topper support and/or adapter described herein to be positioned within, at, on, above, etc., an umbrella. In other approaches, the accessory topper may be specially configured for use and/or integrated with any topper support and/or adapter described herein to be positioned within, at, on, above, etc., an umbrella. In yet other approaches, the accessory topper comprises any fastening mechanism disclosed herein and/or known in the art for detachable coupling to any umbrella known in the art. In other approaches, the accessory topper is permanently integrated with any umbrella known in the art.

In preferred embodiments, the accessory topper is configured to be detachably coupled to any topper support and/or adapter described herein. In some embodiments, the accessory topper may comprise screw on/off threads, string supports, pole support sections, locking joints, push button spring snap locks, etc. The accessory topper may comprise any fastening mechanism described herein and/or known in the art. In some embodiments, the accessory topper may comprise any combination of fastening mechanisms described herein and/or known in the art. In one embodiment, the accessory topper is detachably coupled to a second end of a topper support to be described in detail below. In another embodiment, the accessory topper is detachably coupled to an upper end of any known umbrella as would be understood by one having ordinary skill in the art upon reading the present disclosure. In other approaches, the accessory topper is permanently integrated with an upper end of any known umbrella as would be understood by one having ordinary skill in the art upon reading the present disclosure.

Any topper support and/or adapter described herein may be used in any combination to support an accessory topper. The topper support(s), adapter(s), and/or accessory topper(s) may replace or be used in combination with a conventional umbrella top end pole cap (e.g., any conventional ball, tip, finial, ferrule, etc.) as would be understood by one having ordinary skill in the art upon reading the present disclosure. The topper support(s), adapter(s), and/or accessory topper(s) provide relatively easy assembly/disassembly of distinguishing and/or functional elements within, at, on, above, etc., an umbrella. The topper support(s) and/or adapter(s)

provide increased safety and stability for securing accessory toppers within, at, on, above, etc., an umbrella. The topper support(s) and/or adapter(s) deter theft of accessory toppers which are securely affixed within, at, on, above, etc., an umbrella.

It should be understood by one having ordinary skill in the art that an umbrella as described herein may refer to a patio umbrella, beach umbrella, portable umbrella, umbrella canopy, awning, bungalow, cabana, tent, canopy, cover, cantilever umbrella, chair umbrella, commercial umbrella, market umbrella, industrial umbrella, erectable and/or collapsible shelter, folding canopy, gazebo, sports umbrella, hand umbrella, hut, utility shelter, parasol, sunshade, or any other umbrella, canopy, and/or supporting surfaces known in the art. In various embodiments, an umbrella may comprise a canopy, pole supports, ribbing, stretchers, assembly supports, frame supports, etc. In at least some embodiments, an umbrella may refer to an erectable and collapsible structure comprising a plurality of supporting structures (e.g., canopy supports, etc.) which may be configured to be operatively coupled to a topper support, adapter, and/or accessory topper as described herein. An umbrella may be any variety, type, configuration, design, size, shape, and for any use known in the art.

Conventional umbrellas may comprise an umbrella pole shaft, frame support, canopy portion, and/or an umbrella stationary hub as would be understood by one having ordinary skill in the art.

In various embodiments, topper supports comprise a first end and a second opposite the first end. The first end of the topper support is preferably configured for operative coupling to an upper end of an umbrella. In some approaches, the first end of the topper support may be directly coupled to the upper end of the umbrella. In other approaches, the first end of the topper support may be coupled to an adapter that is coupled to the upper end of the umbrella. In yet another approach, the first end of the topper support may be coupled to a second topper support and/or an adapter that is coupled to the upper end of the umbrella. In a preferred embodiment, the second end of the topper support is positioned above the upper end of the umbrella when the first end is coupled to the upper end of the umbrella. In some embodiments, the first end of the topper support is configured for coupling to an interface connector and the interface connector is coupled to the upper end of the umbrella. In other embodiments, the second end of the topper support is configured for coupling to an interface connector and the interface connector is coupled to a second topper support and/or an adapter.

A second end of the topper support is configured for coupling to an accessory topper in at least some embodiments. In other embodiments, the second end of the topper support is configured for coupling to a second topper support and/or an adapter that is coupled to the accessory topper.

In various approaches, a second topper support comprises a first section and a second section opposite the first section. The second section of the second topper support may be configured for operative coupling to the accessory topper.

FIG. 1 depicts an accessory universal mounting bracket affixing device 100, in accordance with one embodiment. As an option, the present device 100 may be implemented in conjunction with features from any other embodiment listed herein, such as those described with reference to the other FIGS. Of course, however, such device 100 and others presented herein may be used in various applications and/or in permutations which may or may not be specifically described in the illustrative embodiments listed herein. Further, the device 100 presented herein may be used in any desired environment.

The accessory universal mounting bracket affixing device 100 may be a topper pole support in various embodiments of the present invention. In various approaches, the accessory universal mounting bracket affixing device 100 may be interchangeable and/or compatible with any topper support, accessory topper, and/or adapter as described in detail below. The accessory universal mounting bracket affixing device 100 may be configured to position the accessory topper within, at, on, above, etc., an umbrella. The accessory universal mounting bracket affixing device 100 may be non-permanent (e.g., removable) in some embodiments. In other embodiments, the accessory universal mounting bracket affixing device 100 may be integrated as a permanent part of the umbrella and/or accessory topper.

The accessory universal mounting bracket affixing device 100 may comprise any rigid and/or pliable material known in the art. Exemplary materials may include any metal, plastic, rubber, material which may bent, molded, formed, shaped, etc., to securely affix any accessory topper as described herein to an umbrella.

It should be understood by one having ordinary skill in the art that, although the accessory universal mounting bracket affixing device 100 is depicted as an L shape, the accessory universal mounting bracket affixing device 100 may be any complete or partial shape and/or configuration. For example, the accessory universal mounting bracket affixing device 100 may be an O shape, a C shape, round, octagonal, square, triangular, rectangular, hexagonal, oblong, flat, dome, etc.

The accessory universal mounting bracket affixing device 100 includes a substantially horizontal flat base comprising at least one fastening aperture 102. In various embodiments, the fastening aperture 102 may be positioned around an exterior male or interior female threaded umbrella fastener of the umbrella components (e.g., in some approaches, the upper end of the umbrella pole shaft support, the umbrella upper stationary hub support, etc.) and securely affixed between screw on/off threads of the exterior male or interior female threaded umbrella fastener and the male/female counterpart screw on/off threads of a conventional umbrella top end pole cap to secure any accessory topper to an umbrella (various elements listed herein are to be discussed in further detail below).

The accessory universal mounting bracket affixing device 100 includes a substantially vertical tube 104. The vertical tube 104 may comprise at least one anchoring thumb screw fastener 106. The anchoring thumb screw fastener 106 may be of any type known in the art. The anchoring thumb screw fastener 106 may include any combination of screws, nails, washers, nuts, bolts, hooks, eyes, etc. The anchoring thumb screw fastener 106 may be configured to secure (e.g., anchor) any accessory topper as described herein. In a preferred approach, the anchoring thumb screw fastener 106 secures a pole support for an accessory topper as described in detail below. For example, the anchoring thumb screw fastener 106 may be for securing a pole portion of a flag accessory topper. In other approaches, the anchoring thumb screw fastener 106 secures a second topper support and/or an adapter.

The vertical tube 104 may comprise at least one clip fastener 108. The clip fastener 108 may be any clip, buckle, spring snap link, carabiner, clamp, etc., or any combination thereof. In one embodiment, the clip fastener 108 may be a rotating mounting ring with a clip fastener. In a preferred embodiment, the clip fastener 108 secures a string support of an accessory topper. In an alternative embodiment, the clip fastener 108 may be configured to secure an accessory topper at a second location of the accessory topper.

In preferred embodiments, the topper pole support (e.g., accessory universal mounting bracket affixing device 100) is configured to secure the accessory topper in at least one location. For example, the topper pole support may secure a pole portion of an accessory topper (e.g., a flag accessory topper) and/or a clip fastener 108 may secure a string support of an accessory topper (e.g., a kite accessory topper).

Figure 2:
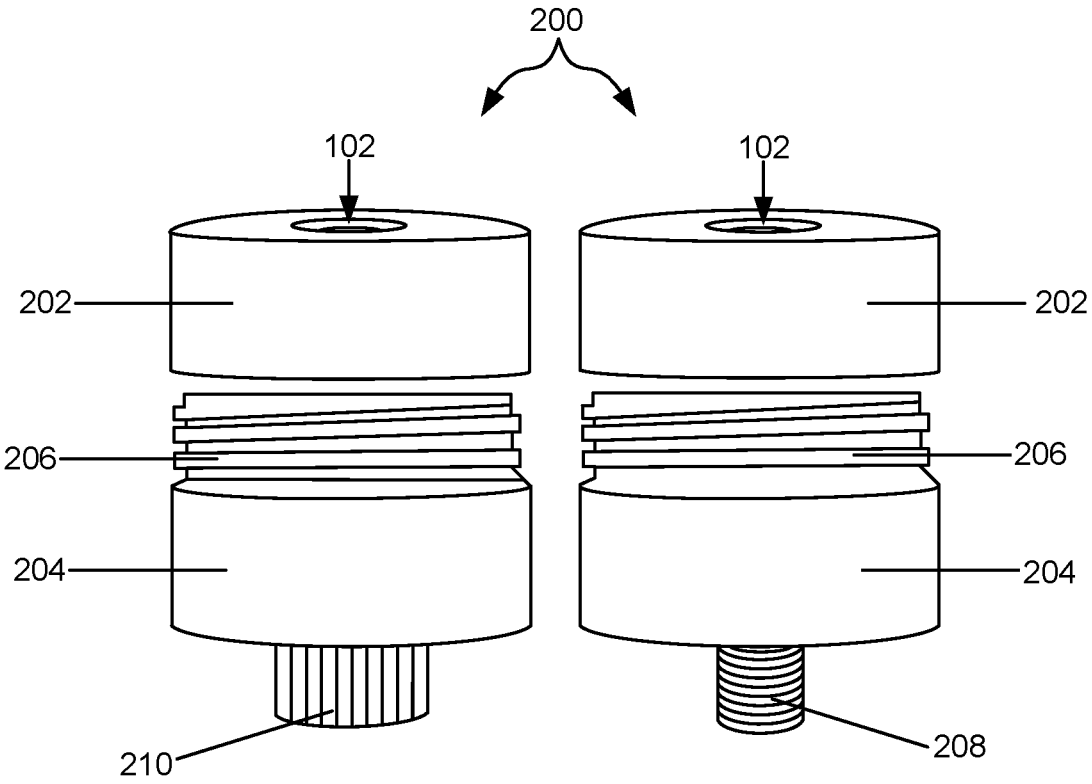
FIG. 2 is an accessory cylindrical two-piece affixing device, according to one embodiment.

FIG. 2 depicts an accessory cylindrical two-piece affixing device 200, in accordance with one embodiment. As an option, the present device 200 may be implemented in conjunction with features from any other embodiment listed herein, such as those described with reference to the other FIGS. Of course, however, such device 200 and others presented herein may be used in various applications and/or in permutations which may or may not be specifically described in the illustrative embodiments listed herein. Further, the device 200 presented herein may be used in any desired environment.

The accessory cylindrical two-piece affixing device 200 may be an adapter in various embodiments of the present invention. In various approaches, the accessory cylindrical two-piece affixing device 200 may be interchangeable and/or compatible with any topper support and/or accessory topper. The accessory cylindrical two-piece affixing device 200 may be configured to position the accessory topper within, at, on, above, etc., an umbrella. The accessory cylindrical two-piece affixing device 200 may be non-permanent (e.g., removable) in some embodiments. In other embodiments, the accessory cylindrical two-piece affixing device 200 may be integrated as a permanent part of the umbrella and/or accessory topper.

The accessory cylindrical two-piece affixing device 200 may comprise any rigid and/or pliable material known in the art. Exemplary materials may include any metal, plastic, rubber, material which may bent, molded, formed, shaped, etc., to securely affix any accessory topper as described herein to an umbrella.

The accessory cylindrical two-piece affixing device 200 includes a top portion 202 and a bottom portion 204. Each portion comprises any fastening mechanisms known in the art for securing the top portion 202 to the bottom portion 204 and vice versa. In a preferred embodiment, the top portion 202 is configured to fasten to the bottom portion 204 via counterpart screw on/off threads 206. The top portion 202 may comprise one or more fastening apertures 102 for fastening an accessory topper with any fastening mechanisms known in the art including screw, bolts, adhesives, etc.

In one embodiment, the bottom portion 204 includes a male threaded connector 208 or a female threaded connector 210. The male threaded connector 208 or female threaded connector 210 may be at the central base of the bottom portion 204 for securely affixing the accessory cylindrical two-piece affixing device 200 to a male or female threaded umbrella fastener 502 (to be described in detail below) comprising screw on/off threads 206.

It should be understood that the accessory cylindrical two-piece affixing device 200 may comprise any fastening mechanisms described in the present disclosure and/or known in the art.

In various approaches, the top portion 202 and the bottom portion 204 may be separable. In another approach, the top portion 202 may be integrated with the bottom portion 204 of the accessory cylindrical two-piece affixing device 200. The top portion 202 may be detachably coupled to the bottom portion 204. The top portion 202 and bottom portion 204 may be individually configured to be operatively coupled to any accessory topper, topper support, and/or upper end of any known umbrella. In various approaches, the bottom portion 204 may be configured for operative coupling to a second topper support. In some approaches, the top portion 202 may be configured for operative coupling to an accessory topper.

In a preferred embodiment, a topper support comprises a first end and a second end opposite the first end and an adapter comprises a top portion and a bottom portion opposite the top portion. The top portion is positioned above the bottom portion when the top portion is coupled to the topper support and the bottom portion of the adapter is configured for operative coupling to an upper end of the umbrella. In one approach, the first end of the topper support is configured for operative coupling to the top portion of the adapter and the second end of the topper support is configured for operative coupling to an accessory topper.

Figure 3:
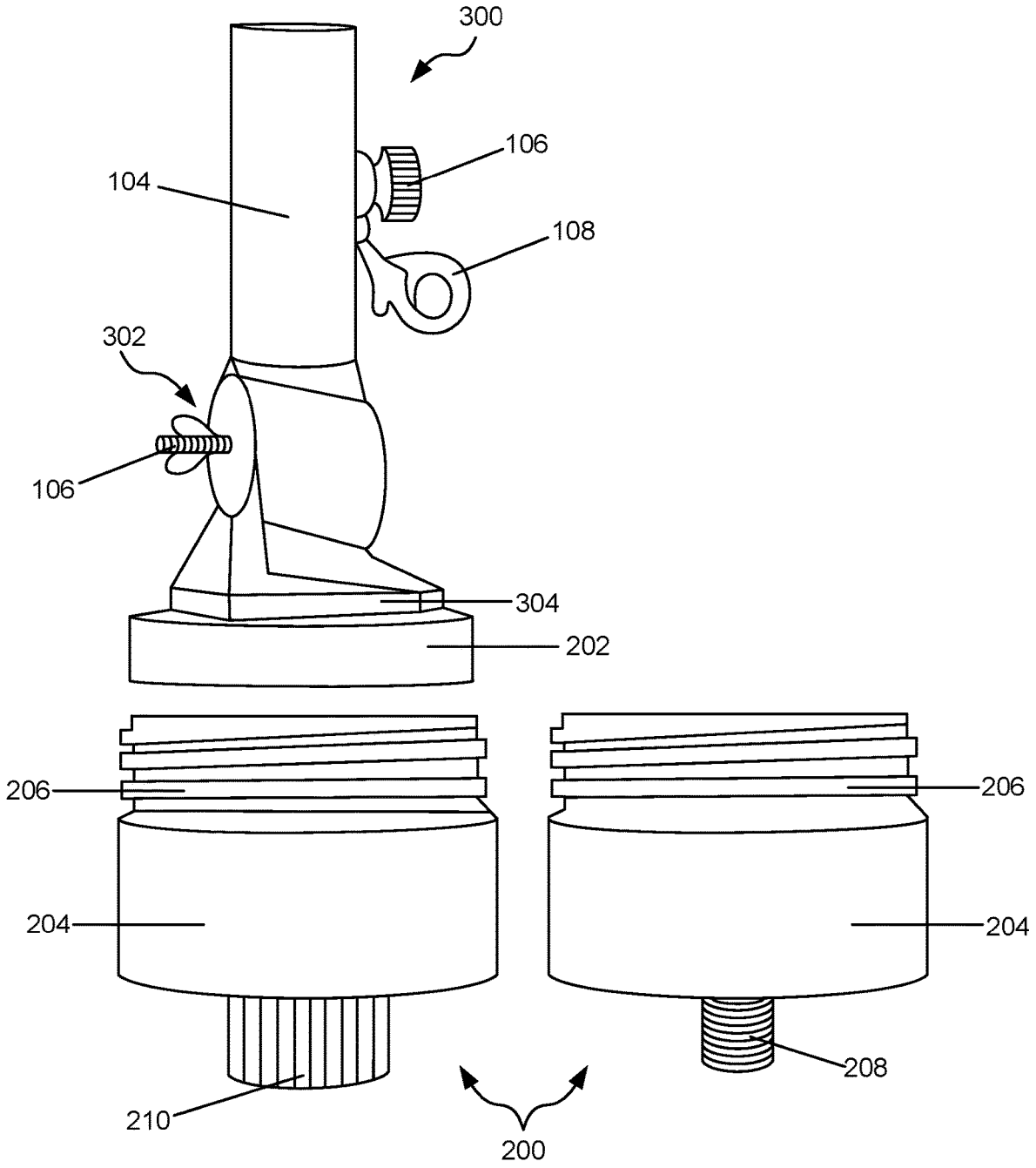
FIG. 3 is an accessory flagpole bracket device, according to one embodiment.

FIG. 3 depicts an accessory flagpole bracket device 300, in accordance with one embodiment. As an option, the present device 300 may be implemented in conjunction with features from any other embodiment listed herein, such as those described with reference to the other FIGS. Of course, however, such device 300 and others presented herein may be used in various applications and/or in permutations which may or may not be specifically described in the illustrative embodiments listed herein. Further, the device 300 presented herein may be used in any desired environment.

In various embodiments, the accessory flagpole bracket device 300 may be a topper support, and, specifically, a topper pole support. In various embodiments, the accessory flagpole bracket device 300 may be interchangeable and/or compatible with any topper support, accessory topper, and/or adapter. The accessory flagpole bracket device 300 may be configured to position the accessory topper within, at, on, above, etc., an umbrella. The accessory flagpole bracket device 300 may be non-permanent (e.g., removable) in some embodiments. In other embodiments, the accessory flagpole bracket device 300 may be integrated as a permanent part of the umbrella and/or accessory topper.

As shown, the accessory flagpole bracket device 300 may be configured to be coupled to the bottom portion 204 of the accessory cylindrical two-piece affixing device 200 (e.g., an adapter). In an exemplary embodiment, the accessory flagpole bracket device 300 may be configured to be usable with the accessory cylindrical two-piece affixing device 200 as shown in FIG. 3. In a preferred embodiment, the combination of the accessory flagpole bracket device 300 and the accessory cylindrical two-piece affixing device 200 may support an accessory topper and replace a conventional umbrella top end pole cap as would be understood by one having ordinary skill in the art upon reading the present disclosure. In another embodiment, the accessory flagpole bracket device 300 may be integrated with the top portion 202 of the accessory cylindrical two-piece affixing device 200 as a topper support as shown.

The accessory flagpole bracket device 300 may comprise any rigid and/or pliable material known in the art. Exemplary materials may include any metal, plastic, rubber, material which may bent, molded, formed, shaped, etc., to securely affix any accessory topper to an umbrella.

The accessory flagpole bracket device 300 may comprise a multi-angle system 302. In various approaches, the multi-angle system 302 is configured to adjust an angle of an accessory topper (e.g., a flag accessory topper) affixed to an umbrella via the accessory flagpole bracket device 300. The multi-angle system 302 may be any multi-angle system known in the art. The multi-angle system 302 may comprise at least one anchoring thumb screw fastener 106 in some embodiments.

The accessory flagpole bracket device 300 comprises a vertical tube 104 configured to act as a topper pole support for pole portions of an accessory topper. In an exemplary embodiment, a pole portion of a flag accessory topper may be secured by the vertical tube 104 of an accessory flagpole bracket device 300.

In various embodiments, the accessory flagpole bracket device 300 may comprise at least one anchoring thumb screw fastener 106 and/or at least one clip fastener 108 as described above in reference to FIG. 1.

The accessory flagpole bracket device 300 includes a bottom base 304. In one embodiment, the bottom base 304 may be configured with suitable fastening mechanisms to be interchangeable and/or compatible with the top portion 202 of the accessory cylindrical two-piece affixing device 200. Suitable fasteners may include counterpart screw on/off threads 206, and/or any other fastening mechanisms described herein, or known in the art. In one embodiment, the bottom base 304 may be integrated with the top portion 202 of the accessory cylindrical two-piece affixing device 200.

Figure 4:
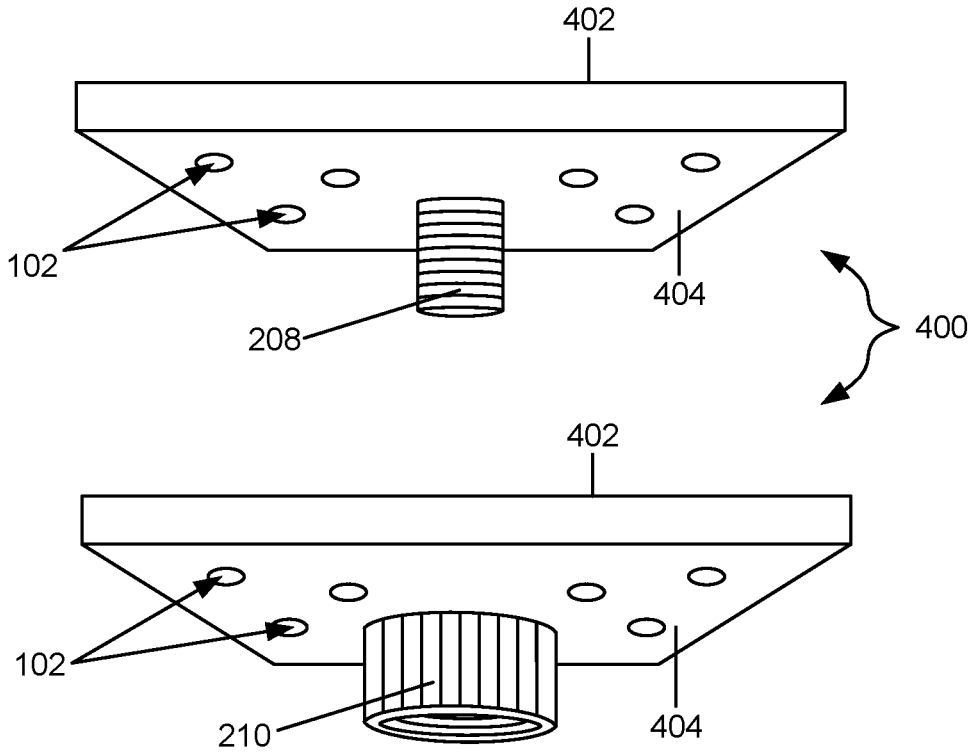
FIG. 4 is an accessory flat one-piece affixing device, according to one embodiment.

FIG. 4 depicts an accessory flat one-piece affixing device 400, in accordance with one embodiment. As an option, the present device 400 may be implemented in conjunction with features from any other embodiment listed herein, such as those described with reference to the other FIGS. Of course, however, such device 400 and others presented herein may be used in various applications and/or in permutations which may or may not be specifically described in the illustrative embodiments listed herein. Further, the device 400 presented herein may be used in any desired environment.

In various embodiments, the accessory flat one-piece affixing device 400 may be a topper support, and, specifically, a topper flat base support. The accessory flat one-piece affixing device 400 may be interchangeable and/or compatible with any topper support, adapter, and/or accessory topper. The accessory flat one-piece affixing device 400 may be configured to position the accessory topper within, at, on, above, etc., an umbrella. The accessory flat one-piece affixing device 400 may be non-permanent (e.g., removable) in some embodiments. In other embodiments, the accessory flat one-piece affixing device 400 may be integrated as a permanent part of the umbrella and/or accessory topper.

The accessory flat one-piece affixing device 400 may comprise any rigid and/or pliable material known in the art. Exemplary materials may include any metal, plastic, rubber, material which may bent, molded, formed, shaped, etc., to securely affix any accessory topper as described herein to an umbrella.

The accessory flat one-piece affixing device 400 includes at least one fastening aperture 102. Any variety and/or combination of screws, bolts, adhesives, etc., may be used to secure an accessory topper to the accessory flat one-piece affixing device 400 using the at least one fastening aperture 102.

In an exemplary embodiment, the accessory flat one-piece affixing device 400 is a substantially flat and square as shown in FIG. 4. It should be appreciated that the accessory flat one-piece affixing device 400 may be any known shape and/or configuration known in the art.

The accessory flat one-piece affixing device 400 comprises a substantially flat top surface 402 and a substantially flat bottom surface 404. The bottom surface 404 comprises a male threaded connector 208 or a female threaded connector 210 at the central base of the accessory flat one-piece affixing device 400 for affixing the accessory flat one-piece affixing device 400 to an umbrella (e.g., in some approaches, to an upper end of the umbrella pole shaft support and/or upper stationary hub support, as a replacement for a conventional umbrella top end pole cap).

In one embodiment, the accessory flat one-piece affixing device 400 comprises an indented hook (not shown) in the central area of the top surface 402 configured to secure at least one location of an accessory topper in some embodiments. In various embodiments, the accessory flat one-piece affixing device 400 may include a clip fastener 108 as described above in reference to FIG. 1 for securing a string support at least one location of an accessory topper. In alternative embodiments, top surface 402 and/or bottom surface 404 may comprise any other suitable fastening mechanisms described herein and/or known in the art. In other embodiments, a string support may secure the accessory topper to the pole support portion of the accessory topper and/or a vertical tube 104 of a topper support.

Figure 5:
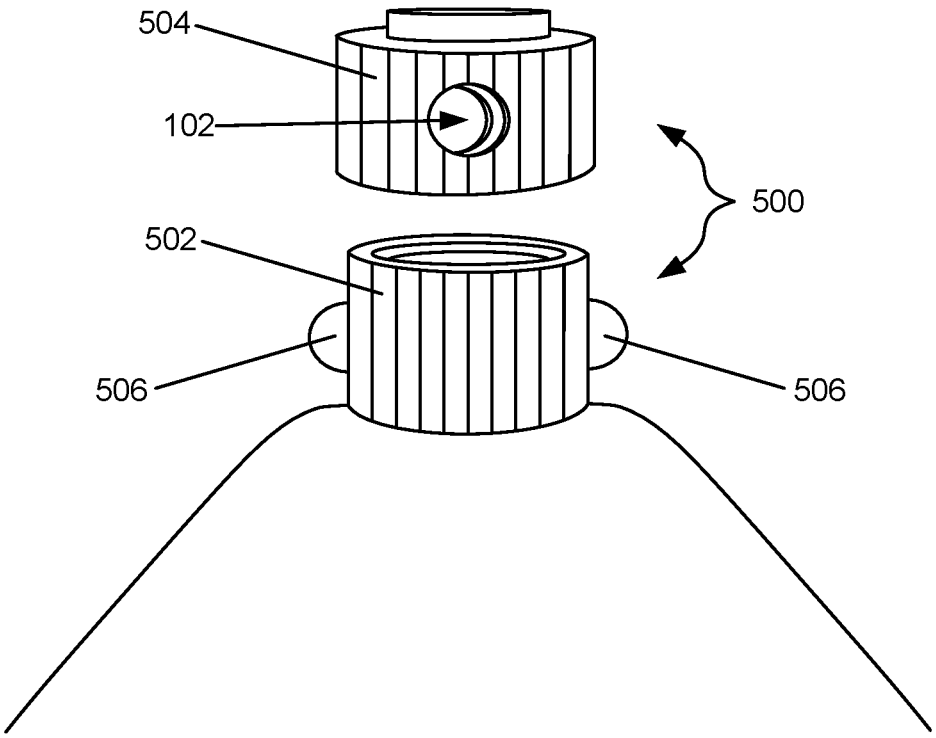
FIG. 5 is an integral push button spring snap-lock affixing device, according to one embodiment.

FIG. 5 depicts an integral push button snap-lock affixing device 500, in accordance with one embodiment. As an option, the present device 500 may be implemented in conjunction with features from any other embodiment listed herein, such as those described with reference to the other FIGS. Of course, however, such device 500 and others presented herein may be used in various applications and/or in permutations which may or may not be specifically described in the illustrative embodiments listed herein. Further, the device 500 presented herein may be used in any desired environment.

In various embodiments, the integral push button snap-lock affixing device 500 may be a topper support. In various approaches, the integral push button snap-lock affixing device 500 may be interchangeable and/or compatible with any topper support, adapter, and/or accessory topper. The integral push button snap-lock affixing device 500 may be configured to position the accessory topper within, at, on, above, etc., an umbrella. The integral push button snap-lock affixing device 500 may be non-permanent (e.g., removable) in some embodiments. In other embodiments, integral push button snap-lock affixing device 500 may be integrated as a permanent part of the umbrella and/or accessory topper.

The integral push button snap-lock affixing device 500 may comprise any rigid and/or pliable material known in the art. Exemplary materials may include any metal, plastic, rubber, material which may bent, molded, formed, shaped, etc., to securely affix any accessory topper as described herein to an umbrella.

The integral push button snap-lock affixing device 500 may be a double end type push button clip insert as shown in FIG. 5. In other embodiments, the integral push button snap-lock affixing device 500 may be a single end, dual end, or any variety of push button clip spring snap-lock devices known in the art.

The integral push button snap-lock affixing device 500 includes an integral affixing device assembly comprising an umbrella fastener 502, a topper fastener 504, a push button clip insert 506, fastening apertures 102, etc. The umbrella fastener 502 may comprise an external male component for the push button clip insert 506. The umbrella fastener 502 may be a permanently integrated component of an upper support area of the umbrella. For example, the umbrella fastener 502 may be integrated into an upper end of an umbrella pole shaft support and/or an umbrella upper stationary hub support.

In one embodiment, the topper fastener 504 is a female counterpart to a male umbrella fastener 502. The topper fastener 504 may be a non-permanent topper support component and may be affixed to a support area of an accessory topper in some approaches. In another approach, the topper fastener 504 may be a permanently integrated component of a support area of the accessory topper. For example, the topper fastener 504 may be integrated into a lower end of an accessory topper pole shaft support and/or an accessory topper flat base support. The topper fastener 504 may comprise any fastening mechanisms as discussed herein for securely affixing an accessory topper to an umbrella and/or the umbrella fastener 502.

In one embodiment, the topper fastener 504 comprises at least one fastening aperture 102 in a side circumference area for securely affixing the male umbrella fastener 502 via a push button clip insert 506. In another embodiment, the male umbrella fastener 502 may comprises exterior buttons of the push button clip insert 506 to lock the fastening apertures 102 of the female topper fastener 504 to the male umbrella fastener 502. In other embodiments, the topper fastener 504 is a male counterpart to a female umbrella fastener 502 as would be understood by one having ordinary skill in the art upon reading the present disclosure.

In an alternative embodiment, the umbrella fastener 502 and/or topper fastener 504 may comprise flat surfaces similar to the top surface 402 and/or the bottom surface 404 as described above in reference to FIG. 4.

The integral push button snap-lock affixing device 500 may comprise any other suitable fastening mechanisms described herein and/or known in the art.

Figure 6:
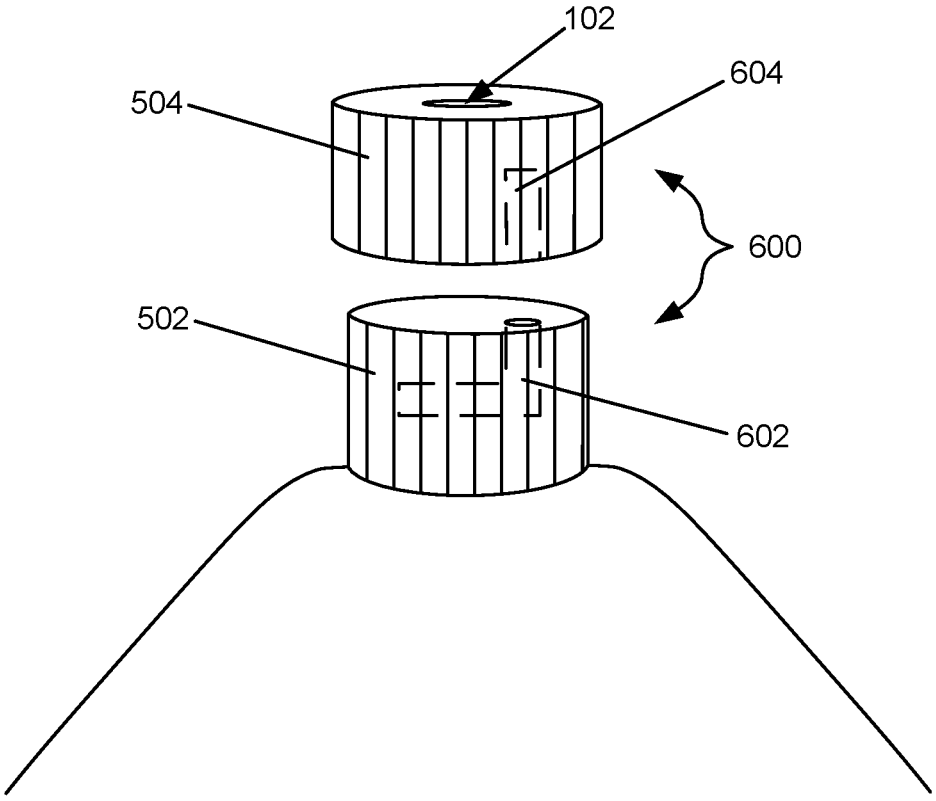
FIG. 6 is an integral locking joint affixing device, according to one embodiment.

FIG. 6 depicts an integral locking joint affixing device 600, in accordance with one embodiment. As an option, the present device 600 may be implemented in conjunction with features from any other embodiment listed herein, such as those described with reference to the other FIGS. Of course, however, such device 600 and others presented herein may be used in various applications and/or in permutations which may or may not be specifically described in the illustrative embodiments listed herein. Further, the device 600 presented herein may be used in any desired environment.

In various embodiments, the integral locking joint affixing device 600 may be a topper support. In various approaches, the integral locking joint affixing device 600 may be interchangeable and/or compatible with any topper support, adapter, and/or accessory topper. The integral locking joint affixing device 600 may be configured to position the accessory topper within, at, on, above, etc., an umbrella. The integral locking joint affixing device 600 may be non-permanent (e.g., removable) in some embodiments. In other embodiments, the integral locking joint affixing device 600 may be integrated as a permanent part of the umbrella and/or accessory topper.

The integral locking joint affixing device 600, may comprise any rigid and/or pliable material known in the art. Exemplary materials may include any metal, plastic, rubber, material which may bent, molded, formed, shaped, etc., to securely affix any accessory topper as described herein to an umbrella.

The integral locking joint affixing device 600 includes an integral affixing device assembly comprising an umbrella fastener 502, a topper fastener 504, a locking joint 602, a locking tab 604, etc. The umbrella fastener 502 may comprise a locking joint 602. The locking joint 602 may comprise at least one vertical and/or horizontal groove as a permanent integral component of the umbrella fastener 502. The umbrella fastener 502 may be a permanently integrated component of an upper support area of the umbrella. For example, the umbrella fastener 502 may be integrated into an upper end of an umbrella pole shaft support and/or an umbrella upper stationary hub support. The locking joint 602 may comprise any mechanical tab-like fastener on the internal area of the umbrella fastener 502. The mechanical tab-like fastener may be a molded tab, hinge, hook, extremity, rivet, pop rivet, pin, bolt, etc., as described herein, or known in the art.

In one embodiment, the topper fastener 504 is a female counterpart to a male umbrella fastener 502. The topper fastener 504 is a non-permanent accessory component and may be affixed to a support area of an accessory topper in some approaches. In another approach, the topper fastener 504 may be a permanently integrated component of a support area of the accessory topper. For example, the topper fastener 504 may be integrated into a lower end of an accessory topper pole shaft support and/or an accessory topper flat base support. The topper fastener 504 may comprise any fastening mechanisms as discussed herein for securely affixing an accessory topper to an umbrella.

In one embodiment, the topper fastener 504 comprises a locking tab 604. The locking tab 604 may comprise a mechanical tab fastener on a relatively internal area of the topper fastener 504. The mechanical tab fastener may be a molded tab, hinge, hook, extremity, rivet, pop rivet, pin, bolt, or any mechanical tab known in the art. The locking tab 604 may be configured to affix the male umbrella fastener 502 with a locking joint 602 via sliding the female topper fastener 504 with a locking tab 604 down a vertical slot of the male umbrella fastener 502 and twisting the female topper fastener 504 along the horizontal slot to securely lock the joints of the female topper fastener 504 and the male umbrella fastener 502.

In other embodiments, the topper fastener 504 is a male counterpart to a female umbrella fastener 502 as would be understood by one having ordinary skill in the art upon reading the present disclosure.

In an alternative embodiment, the umbrella fastener 502 and/or topper fastener 504 may comprise flat surfaces similar to the top surface 402 and/or the bottom surface 404 as described above in reference to FIG. 4.

As shown, the integral locking joint affixing device 600 comprises an exemplary single type locking joint 602 and an exemplary single type locking tab 604. It should be understood by one having ordinary skill in the art upon reading the disclosure that the integral locking joint affixing device 600 may comprise double locking joints, double locking tabs, or any variety and/or combination of locking joints and locking tabs known in the art.

The integral locking joint affixing device 600 may comprise any other suitable fastening mechanisms such as fastening apertures 102, screw on/off threads 206, or any other fastening mechanisms described herein and/or known in the art.

Figure 7:
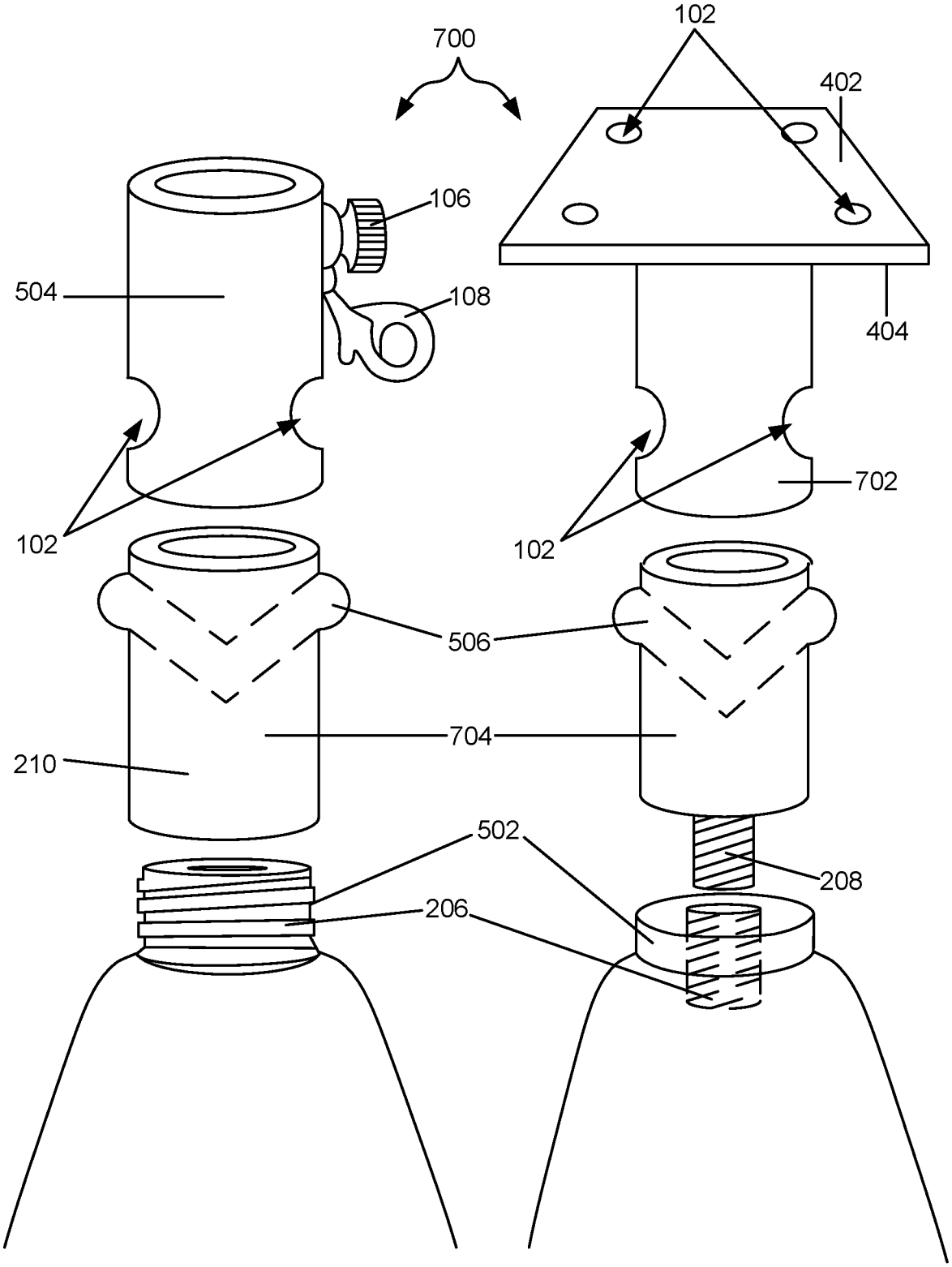
FIG. 7 is an accessory push button spring snap-lock affixing device, according to one embodiment.

FIG. 7 depicts an accessory push button spring snap-lock affixing device 700, in accordance with one embodiment. As an option, the present device 700 may be implemented in conjunction with features from any other embodiment listed herein, such as those described with reference to the other FIGS. Of course, however, such device 700 and others presented herein may be used in various applications and/or in permutations which may or may not be specifically described in the illustrative embodiments listed herein. Further, the device 700 presented herein may be used in any desired environment.

In various embodiments, the accessory push button spring snap-lock affixing device 700 comprises a first topper support, an interface connector (e.g., 704), and a second topper support. The accessory push button spring snap-lock affixing device 700 may be interchangeable and/or compatible with any topper support, adapter, and/or accessory topper. The accessory push button spring snap-lock affixing device 700 may be configured to position the accessory topper within, at, on, above, etc., an umbrella. The accessory push button spring snap-lock affixing device 700 may be non-permanent (e.g., removable) in some embodiments. In other embodiments, accessory push button spring snap-lock affixing device 700 may be integrated as a permanent part of the umbrella and/or accessory topper.

The accessory push button spring snap-lock affixing device 700 may comprise any rigid and/or pliable material known in the art. Exemplary materials may include any metal, plastic, rubber, material which may bent, molded, formed, shaped, etc., to securely affix any accessory topper as described herein to an umbrella.

The accessory push button spring snap-lock affixing device 700 is an accessory affixing device assembly comprising any combination of an umbrella fastener 502, a topper fastener 504, a topper flat base fastener 702, an interface connector 704, etc.

The umbrella fastener 502 may be a topper support coupled to an interface connector 704 for coupling to another topper support (e.g., as shown, the topper fastener 504 or the topper flat base fastener 702). The umbrella fastener 502 comprises external male or internal female screw on/off threads 206 and may be a permanently integrated component of an upper support area of the umbrella. For example, the umbrella fastener 502 may be integrated into an upper end of the umbrella pole shaft support and/or the umbrella upper stationary hub support.

The interface connector 704 comprises a counterpart to the male or female umbrella fastener 502. The interface connector 704 may be a non-permanent interface connector for operative coupling to a female topper fastener 504 or a topper flat base fastener 702. In one embodiment, the interface connector 704 may comprise a male threaded connector 208 or a female threaded connector 210. The male threaded connector 208 or female threaded connector 210 may comprise screw on/off threads 206 for coupling the interface connector 704 to the umbrella fastener 502.

In one embodiment, the interface connector 704 comprises a male top end push button clip insert 506 configured to secure the topper fastener 504 or the topper flat base fastener 702. In other embodiments, the interface connector 704 may comprise counterpart screw on/off threads or any other suitable fastening mechanisms described herein and/or known in the art.

The topper fastener 504 may be a topper pole support in at least some embodiments. The topper fastener 504 is a non-permanent (e.g., removable) accessory component and may be affixed to a support area of an accessory topper in some approaches. In other embodiments, the topper fastener 504 may be permanently integrated as part of the accessory topper and/or umbrella. The topper fastener 504 may comprise any fastening mechanisms discussed herein for securely affixing an accessory topper to an umbrella. The topper fastener 504 comprises at least one fastening aperture 102 in a side circumference area for securely affixing the push button clip insert 506 of the interface connector 704.

In various embodiments, the topper fastener 504 includes at least one anchoring thumb screw fastener 106. The anchoring thumb screw fastener 106 may be of any type known in the art. The anchoring thumb screw fastener 106 may include any combination of screws, nails, washers, nuts, bolts, hooks, eyes, etc. The anchoring thumb screw fastener 106 may be configured to secure (e.g., anchor) any accessory topper as described herein. In a preferred approach, the anchoring thumb screw fastener 106 secures a pole support for an accessory topper as described in detail below. For example, the anchoring thumb screw fastener 106 may be for securing a flag accessory topper. In other approaches, the anchoring thumb screw fastener 106 secures an additional topper support and/or an adapter.

The topper fastener 504 may comprise at least one clip fastener 108. The clip fastener 108 may be any clip, buckle, spring snap link, carabiner, clamp, etc., or any combination thereof. In one embodiment, the clip fastener 108 may be a rotating mounting ring with a clip fastener. In a preferred embodiment, the clip fastener 108 secures a string support for an accessory topper. For example, the clip fastener 108 may be configured to secure an accessory topper at at least one location of an accessory topper (e.g., a string support of a kite accessory topper).

The topper flat base fastener 702 may be a topper flat base support in at least some embodiments. In various embodiments, the topper flat base fastener 702 is a non-permanent (e.g., removable) accessory component and may be affixed to a support area of an accessory topper in some approaches. The topper flat base fastener 702 may comprise any fastening mechanisms discussed herein for securely affixing an accessory topper to an umbrella. The topper flat base fastener 702 comprises at least one fastening aperture 102 in a side circumference area for securely affixing the push button clip insert 506 of the interface connector 704.

In various embodiments, the topper flat base fastener 702 may be a topper support. The topper flat base fastener 702 may be interchangeable and/or compatible with any topper support, adapter, and/or accessory topper. The topper flat base fastener 702 may be configured to position the accessory topper within, at, on, above, etc., an umbrella. The topper flat base fastener 702 may be non-permanent (e.g., removable) in some embodiments. In other embodiments, the topper flat base fastener 702 may be permanently integrated as part of the umbrella and/or accessory topper.

The topper flat base fastener 702 may comprise any rigid and/or pliable material known in the art. Exemplary materials may include any metal, plastic, rubber, material which may bent, molded, formed, shaped, etc., to securely affix any accessory topper as described herein to an umbrella.

The topper flat base fastener 702 includes at least one fastening aperture 102. Any variety and/or combination of screws, bolts, adhesives, etc., may be used to secure an accessory topper to the topper flat base fastener 702 using the at least one fastening aperture 102.

In an exemplary embodiment, the topper flat base fastener 702 is a substantially flat and square as shown in FIG. 7. The topper flat base fastener 702 comprises a substantially flat top surface 402 and a substantially flat bottom surface 404. It should be appreciated that the topper flat base fastener 702 may be any known shape and configuration known in the art.

In one embodiment, the topper flat base fastener 702 comprises an indented hook (not shown) in the central area of the top surface 402 configured to secure at least one location of an accessory topper in some embodiments. In various embodiments, the topper flat base fastener 702 may include a clip fastener 108 as described above in reference to FIG. 1 for securing at least one location of an accessory topper. In other embodiments, a string support may secure the accessory topper to the pole support portion of the accessory topper and/or a vertical tube 104 of a topper support. In alternative embodiments, the top surface 402 and/or bottom surface 404 may comprise other suitable fastening mechanisms described herein. In another embodiment, the accessory push button spring snap-lock affixing device 700 may comprise any other suitable fastening mechanisms described herein and/or known in the art.

Figure 8:
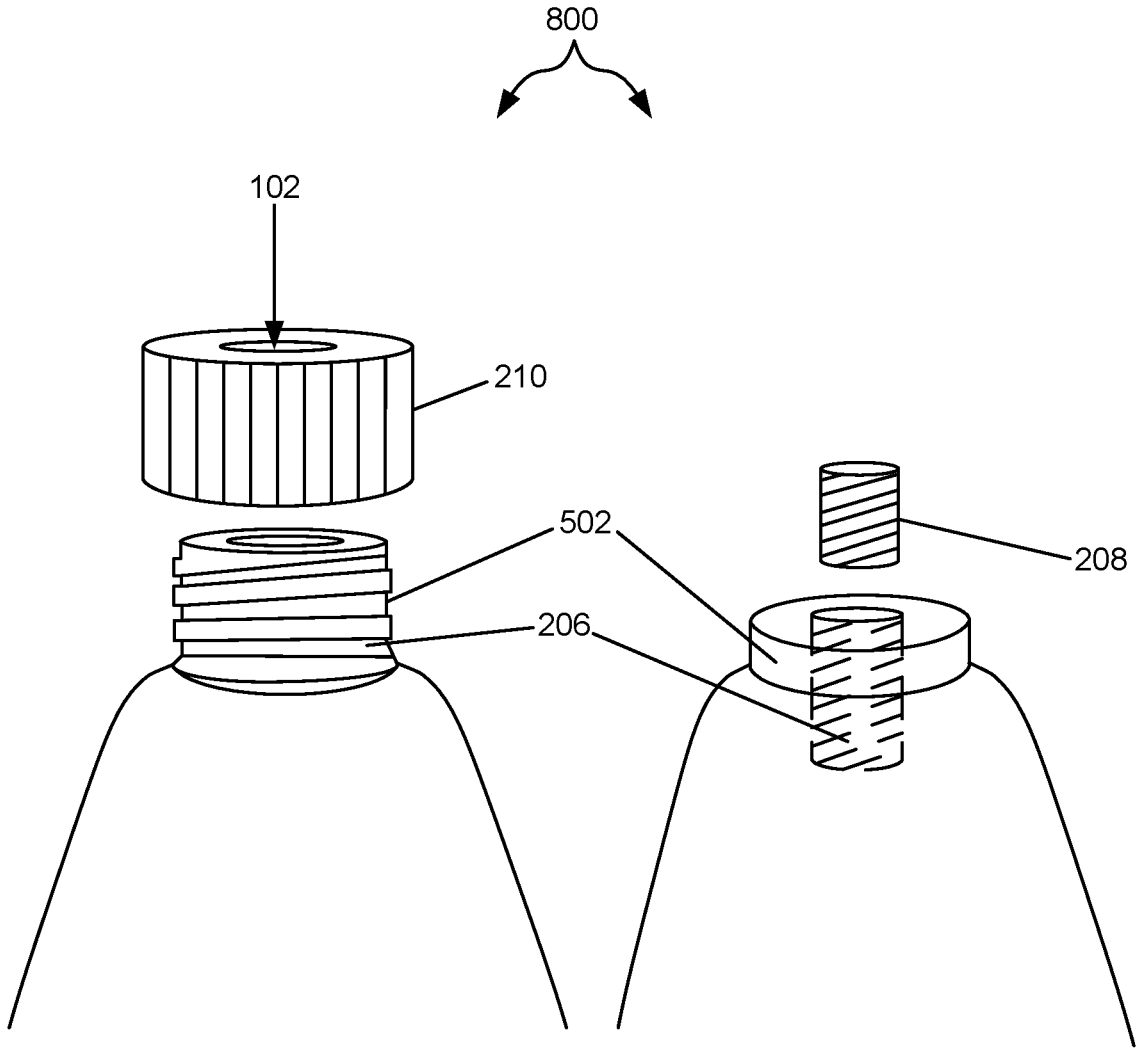
FIG. 8 depicts alternate accessory threaded connectors affixing device, according to various embodiments.

FIG. 8 depicts an accessory threaded connector affixing device 800, in accordance with one embodiment. As an option, the present device 800 may be implemented in conjunction with features from any other embodiment listed herein, such as those described with reference to the other FIGS. Of course, however, such device 800 and others presented herein may be used in various applications and/or in permutations which may or may not be specifically described in the illustrative embodiments listed herein. Further, the device 800 presented herein may be used in any desired environment.

In various embodiments, the accessory threaded connector affixing device 800 comprises a topper support. The accessory threaded connector affixing device 800 may be interchangeable and/or compatible with any topper support, adapter, and/or accessory topper. The accessory threaded connector affixing device 800 may be configured to position the accessory topper within, at, on, above, etc., an umbrella. The accessory threaded connector affixing device 800 may be non-permanent (e.g., removable) in some embodiments. In other embodiments, the accessory threaded connector affixing device 800 may be permanently integrated as part of the umbrella and/or accessory topper.

The accessory threaded connector affixing device 800 may comprise a male threaded connector 208 or a female threaded connector 210. The male threaded connector 208 or female threaded connector 210 may be for securely affixing the accessory threaded connector affixing device 800 to a male or female umbrella fastener 502 comprising screw on/off threads 206. In various embodiments, the male threaded connector 208 may be integrated with the female threaded connector 210 for fastening to an accessory topper and/or a male or female threaded umbrella fastener 502 comprising screw on/off threads 206.

The accessory threaded connector affixing device 800 may comprise one or more fastening apertures 102 for fastening an accessory topper, topper support, and/or adapter with any fastening mechanisms known in the art including screw, bolts, adhesives, etc. In various embodiments, the accessory threaded connector affixing device 800 may include a clip fastener 108 as described above in reference to FIG. 1 for securing at least one location of an accessory topper. In other embodiments, a string support may secure the accessory topper to the pole support portion of the accessory topper and/or a vertical tube 104 of a topper support. In alternative embodiments, the accessory threaded connector affixing device 800 may comprise any other suitable fastening mechanisms described herein and/or known in the art.

Figure 9:
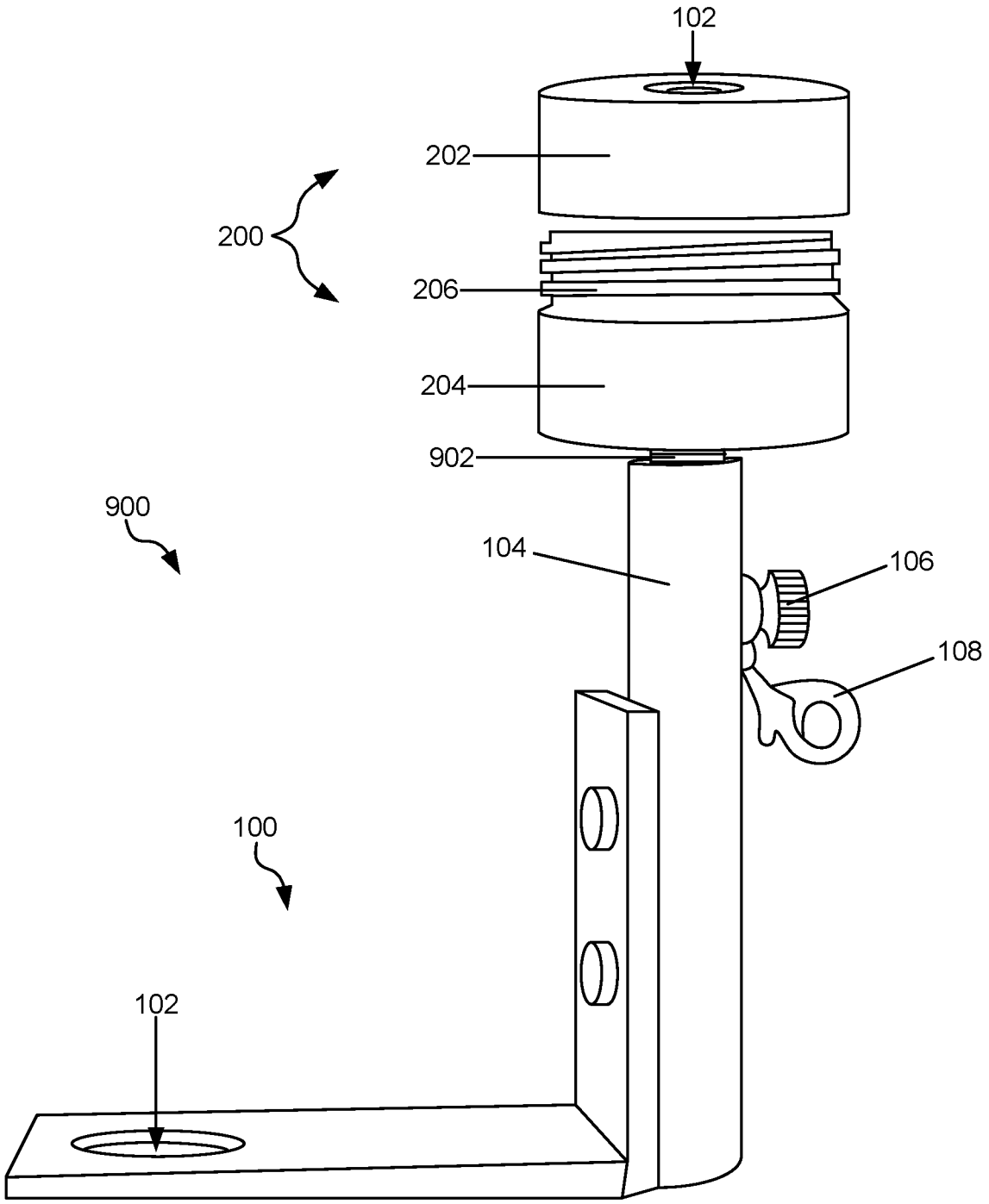
FIG. 9 is a system, according to one embodiment.

FIG. 9 depicts a system 900, in accordance with one embodiment. As an option, the present system 900 may be implemented in conjunction with features from any other embodiment listed herein, such as those described with reference to the other FIGS. Of course, however, such system 900 and others presented herein may be used in various applications and/or in permutations which may or may not be specifically described in the illustrative embodiments listed herein. Further, the system 900 presented herein may be used in any desired environment.

In various embodiments, system 900 comprises a topper support (e.g., an accessory universal mounting bracket affixing device 100) operatively coupled to an adapter (e.g., an accessory cylindrical two-piece affixing device 200). The various components of the system 900 may be interchangeable and/or compatible with any topper support, adapter, and/or accessory topper. The system 900 may be configured to position the accessory topper within, at, on, above, etc., an umbrella. The system 900 may be non-permanent (e.g., removable) in some embodiments. In other embodiments, the system 900 may be integrated as a permanent part of the umbrella and/or accessory topper.

In an exemplary embodiment, system 900 comprises an accessory cylindrical two-piece affixing device 200 operatively coupled to an accessory universal mounting bracket affixing device 100 via an anchoring pole support 902.

The accessory universal mounting bracket affixing device 100 may be a topper support in various embodiments of the present invention. In various approaches, the accessory universal mounting bracket affixing device 100 may be interchangeable and/or compatible with any topper support, accessory topper, and/or adapter as described in detail below. The accessory universal mounting bracket affixing device 100 may be configured to position the accessory topper within, at, on, above, etc., an umbrella. The accessory universal mounting bracket affixing device 100 may be non-permanent (e.g., removable) in some embodiments. In other embodiments, the accessory universal mounting bracket affixing device 100 may be integrated as a permanent part of the umbrella and/or accessory topper.

The accessory universal mounting bracket affixing device 100 may comprise any rigid and/or pliable material known in the art. Exemplary materials may include any metal, plastic, rubber, material which may bent, molded, formed, shaped, etc., to securely affix any accessory topper as described herein to an umbrella.

It should be understood by one having ordinary skill in the art that, although the accessory universal mounting bracket affixing device 100 is depicted as an L shape, the accessory universal mounting bracket affixing device 100 may be any complete or partial shape and/or configuration. For example, the accessory universal mounting bracket affixing device 100 may be an O shape, a C shape, round, octagonal, square, triangular, rectangular, hexagonal, oblong, flat, dome, etc.

The accessory universal mounting bracket affixing device 100 includes a substantially horizontal flat base comprising at least one fastening aperture 102. In various embodiments, the fastening aperture 102 may be positioned around an exterior male or interior female threaded umbrella fastener of the umbrella components (e.g., in some approaches, the upper end of the umbrella pole shaft support, the umbrella upper stationary hub support, etc.) and securely affixed between screw on/off threads of the exterior male or interior female threaded umbrella fastener and the male/female counterpart screw on/off threads of a conventional umbrella top end pole cap to secure any accessory topper to an umbrella.

The accessory universal mounting bracket affixing device 100 includes a substantially vertical tube 104. The vertical tube 104 may comprise at least one anchoring thumb screw fastener 106. The anchoring thumb screw fastener 106 may be of any type known in the art. The anchoring thumb screw fastener 106 may include any combination of screws, nails, washers, nuts, bolts, hooks, eyes, etc. The anchoring thumb screw fastener 106 may be configured to secure (e.g., anchor) any accessory topper as described herein. In a preferred approach, the anchoring thumb screw fastener 106 secures a pole support for an accessory topper as described in detail below. For example, the anchoring thumb screw fastener 106 may be for securing a flag accessory topper. In other approaches, the anchoring thumb screw fastener 106 secures a second topper support and/or an adapter.

The vertical tube 104 may comprise at least one clip fastener 108. The clip fastener 108 may be any clip, buckle, spring snap link, carabiner, clamp, etc., or any combination thereof. In one embodiment, the clip fastener 108 may be a rotating mounting ring with a clip fastener. In a preferred embodiment, the clip fastener 108 secures a string support of an accessory topper (e.g., a kite accessory topper). In an alternative embodiment, the clip fastener 108 may be configured to secure an accessory topper at in at least one location of the accessory topper.

The accessory cylindrical two-piece affixing device 200 may be an adapter in various embodiments of the present invention. In various approaches, the accessory cylindrical two-piece affixing device 200 may be interchangeable and/or compatible with any topper support and/or accessory topper. The accessory cylindrical two-piece affixing device 200 may be configured to position the accessory topper within, at, on, above, etc., an umbrella. The accessory cylindrical two-piece affixing device 200 may be non-permanent (e.g., removable) in some embodiments. In other embodiments, the accessory cylindrical two-piece affixing device 200 may be permanently integrated as part of the umbrella and/or accessory topper.

The accessory cylindrical two-piece affixing device 200 may comprise any rigid and/or pliable material known in the art. Exemplary materials may include any metal, plastic, rubber, material which may bent, molded, formed, shaped, etc., to securely affix any accessory topper as described herein to an umbrella.

The accessory cylindrical two-piece affixing device 200 includes a top portion 202 and a bottom portion 204. Each portion comprises any fastening mechanisms known in the art for securing the top portion 202 to the bottom portion 204 and vice versa. In a preferred embodiment, the top portion 202 is configured to fasten to the bottom portion 204 via counterpart screw on/off threads 206. The top portion 202 may comprise one or more fastening apertures 102 for fastening an accessory topper with any fastening mechanisms known in the art including screw, bolts, adhesives, etc.

In one embodiment, the bottom portion 204 includes a male threaded connector 208 or a female threaded connector 210. The male threaded connector 208 or female threaded connector 210 may be at the central base of the bottom portion 204 for securely affixing the accessory cylindrical two-piece affixing device 200 to a male or female threaded umbrella fastener 502 comprising screw on/off threads 206.

It should be understood that the accessory cylindrical two-piece affixing device 200 may comprise any fastening mechanisms described in the present disclosure and/or known in the art.

In various approaches, the top portion 202 and the bottom portion 204 may be separable. In another approach, the top portion 202 may be integrated with the bottom portion 204 of the accessory cylindrical two-piece affixing device 200. The top portion 202 and bottom portion 204 may be individually configured to be operatively coupled to any accessory topper and/or a topper support.

The accessory cylindrical two-piece affixing device 200 system 900 comprises an anchoring pole support 902. The anchoring pole support 902 may be inserted into the vertical tube 104 and secured via the anchoring thumb screw fastener 106 of the accessory universal mounting bracket affixing device 100. In other approaches, the anchoring pole support 902 may be secured using any fastening mechanism described herein as would be understood by one of ordinary skill in the art upon the present disclosure.

Figure 10:
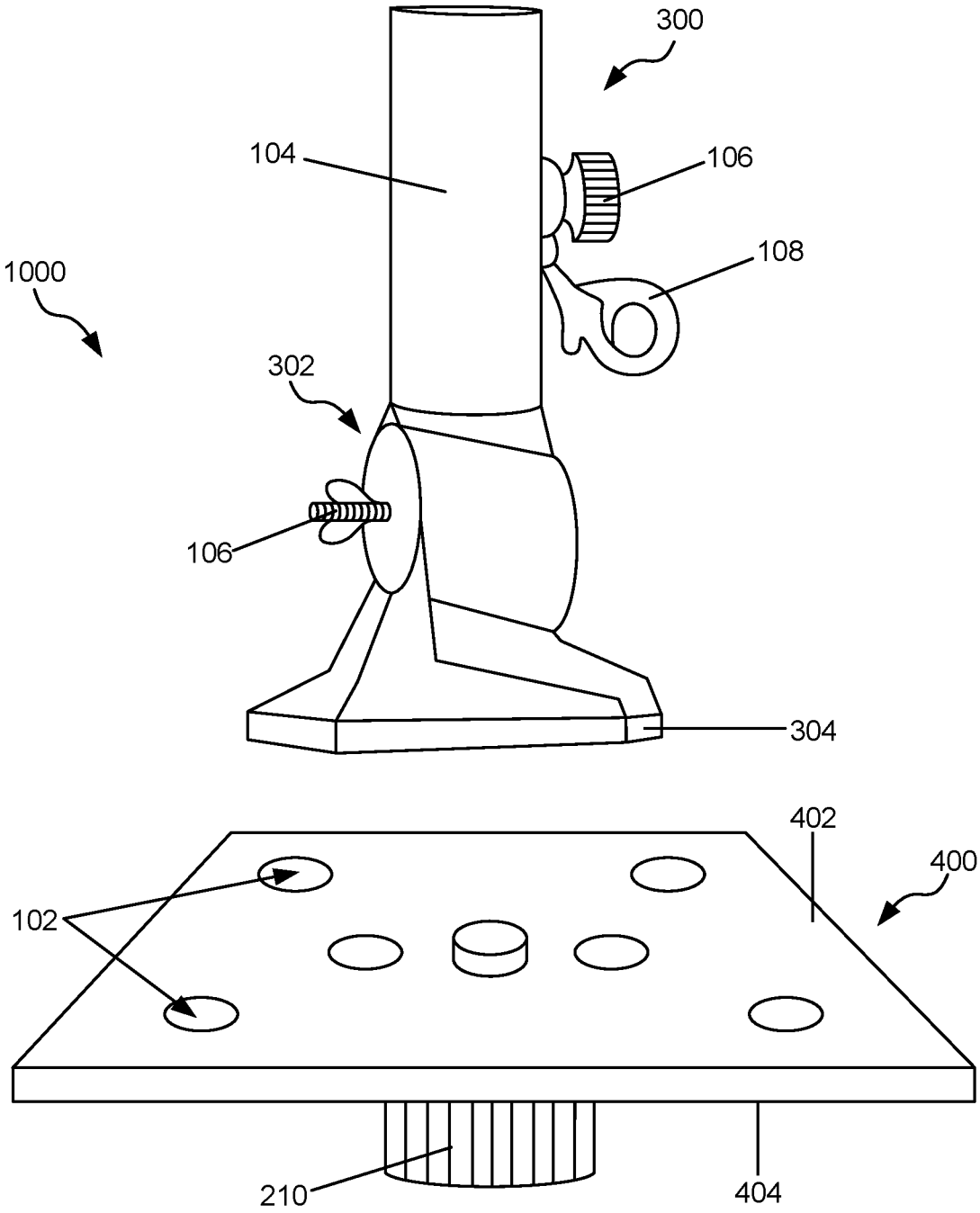
FIG. 10 is a system, according to one embodiment.

FIG. 10 depicts a system 1000, in accordance with one embodiment. As an option, the present system 1000 may be implemented in conjunction with features from any other embodiment listed herein, such as those described with reference to the other FIGS. Of course, however, such system 1000 and others presented herein may be used in various applications and/or in permutations which may or may not be specifically described in the illustrative embodiments listed herein. Further, the system 1000 presented herein may be used in any desired environment.

In various embodiments, system 1000 comprises a first topper support operatively coupled to a second topper support. The various components of the system 1000 may be interchangeable and/or compatible with any topper support, adapter, and/or accessory topper. The system 1000 may be configured to position the accessory topper within, at, on, above, etc., an umbrella. The system 1000 may be non-permanent (e.g., removable) in some embodiments. In other embodiments, the system 1000 may be permanently integrated as part of the umbrella and/or accessory topper.

In an exemplary embodiment, system 1000 comprises an accessory flagpole bracket device 300 operatively coupled to an accessory flat one-piece affixing device 400.

The accessory flagpole bracket device 300 may comprise a multi-angle system 302. In various approaches, the multi-angle system 302 is configured to adjust an angle of an accessory topper (e.g., in one example, a flag topper) affixed to an umbrella via the accessory flagpole bracket device 300. The multi-angle system 302 may be any multi-angle system known in the art.

The accessory flagpole bracket device 300 comprises a vertical tube 104 configured to secure a pole support for an accessory topper (e.g., in an exemplary embodiment, a pole portion of a flag accessory topper).

In various embodiments, the accessory flagpole bracket device 300 may comprise at least one anchoring thumb screw fastener 106 and/or at least one clip fastener 108 as described above in reference to FIG. 1.

The accessory flagpole bracket device 300 includes a bottom base 304. In one embodiment, the bottom base 304 may be configured with suitable fastening mechanisms to be interchangeable and/or compatible with accessory flat one-piece affixing device 400.

The accessory flat one-piece affixing device 400 includes at least one fastening aperture 102. Any variety and/or combination of screws, bolts, adhesives, etc., may be used to secure an accessory topper to the accessory flat one-piece affixing device 400 using the at least one fastening aperture 102.

In an exemplary embodiment, the accessory flat one-piece affixing device 400 is a substantially flat and square as shown in FIG. 10. It should be appreciated that the accessory flat one-piece affixing device 400 may be any known shape and/or configuration known in the art.

The accessory flat one-piece affixing device 400 comprises a substantially flat top surface 402 and a substantially flat bottom surface 404. The bottom surface 404 comprises a male threaded connector 208 or a female threaded connector 210 at the central base of the accessory flat one-piece affixing device 400 for affixing the accessory flat one-piece affixing device 400 to an umbrella (e.g., in some approaches, to an upper end of the umbrella pole shaft support and/or upper stationary hub support, as a replacement for a conventional umbrella top end pole cap).

In one embodiment, the accessory flat one-piece affixing device 400 comprises an indented hook (not shown) in the central area of the top surface 402 configured to secure at least one location of an accessory topper in some embodiments. In various embodiments, the accessory flat one-piece affixing device 400 may include a clip fastener 108 as described above in reference to FIG. 1 for securing at least one location of an accessory topper. In other embodiments, a string support may secure the accessory topper to the pole support of the accessory topper and/or the topper support. In alternative embodiments, the bottom surface 404 may comprise other suitable fastening mechanisms described herein, or known in the art.

In one embodiment, an accessory flagpole bracket device 300 may be operatively coupled to an accessory flat one-piece affixing device 400 using any of the fastening mechanisms described herein and/or known in the art. In another embodiment, the accessory flagpole bracket device 300 may be integrated with the accessory flat one-piece affixing device 400.

Figure 11:
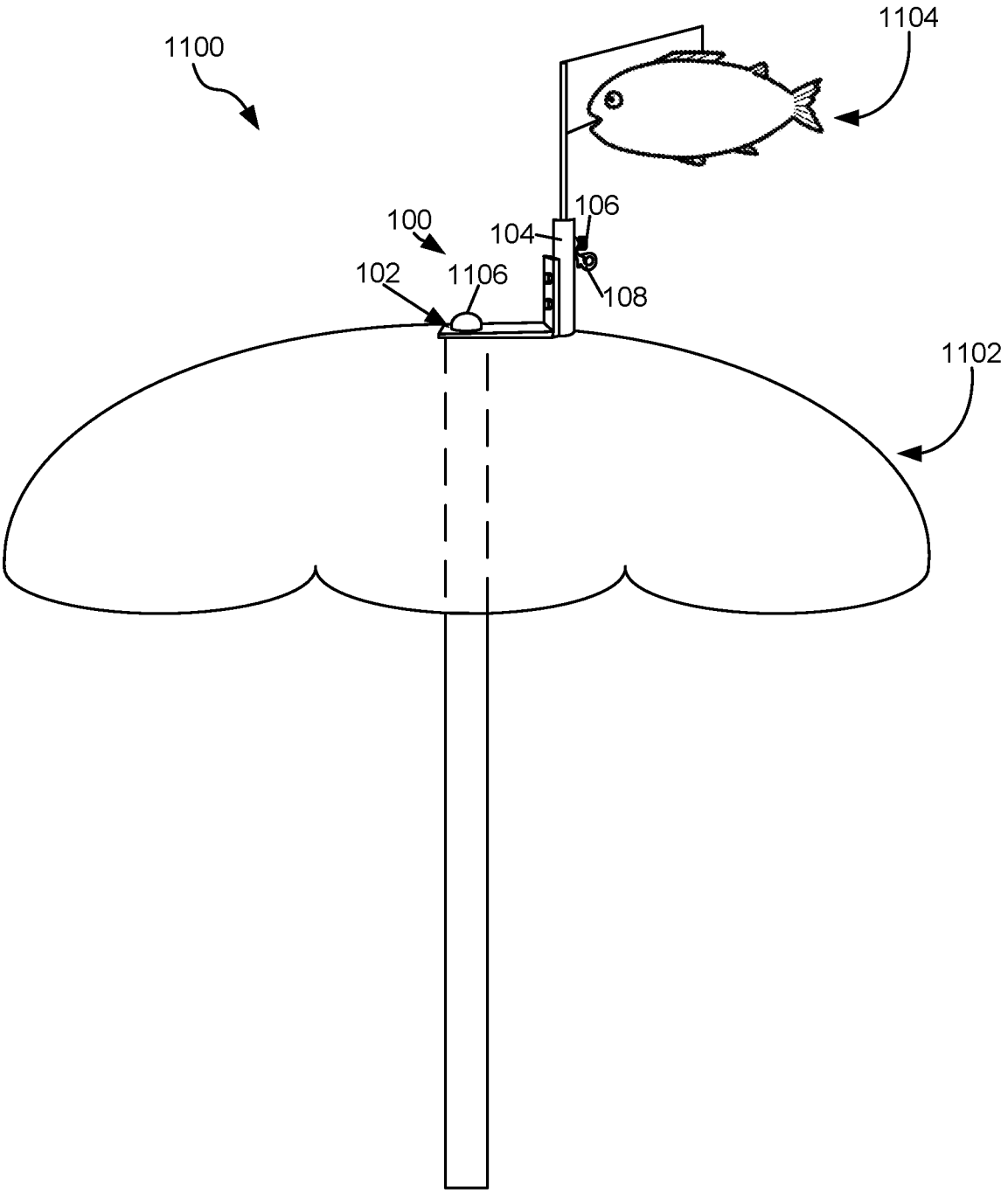
FIG. 11 is a system, according to one embodiment.

FIG. 11 depicts a system 1100, in accordance with one embodiment. As an option, the present system 1100 may be implemented in conjunction with features from any other embodiment listed herein, such as those described with reference to the other FIGS. Of course, however, such system 1100 and others presented herein may be used in various applications and/or in permutations which may or may not be specifically described in the illustrative embodiments listed herein. Further, the system 1100 presented herein may be used in any desired environment.

As shown in FIG. 11, system 1100 comprises an umbrella 1102. The umbrella may be any patio umbrella, beach umbrella, portable umbrella, umbrella canopy, awning, bungalow, cabana, tent, canopy, cover, cantilever umbrella, chair umbrella, commercial umbrella, market umbrella, industrial umbrella, erectable and/or collapsible shelter, folding canopy, gazebo, sports umbrella, hand umbrella, hut, utility shelter, parasol, sunshade, or any other umbrella, canopy, and/or supporting surfaces known in the art. The umbrella 1102 may any variety and/or type of umbrella in any configuration, design, size, shape, use, etc., known in the art.

System 1100 comprises an accessory topper 1104. The accessory topper 1104 is positioned above the umbrella 1102 by a topper pole support (e.g., as shown, accessory universal mounting bracket affixing device 100 secured by any conventional umbrella top end pole cap 1106). The conventional umbrella top end pole cap 1106 may be any conventional ball, tip, finial, ferrule, etc., as would be understood by one having ordinary skill in the art upon reading the present disclosure. In an alternative embodiment, the topper pole support (e.g., as shown, accessory universal mounting bracket affixing device 100) may be secured by an accessory threaded connector affixing device 800, any topper support, any adapter, and/or any suitable fastening mechanisms described herein and/or known in the art. The pole portion of the accessory topper 1104 may be secured by the combination of the vertical tube 104 and at least one anchoring thumb screw fastener 106. In an alternative embodiment, a string support of an accessory topper 1104 may be secured by the clip fastener 108.

Figure 12:
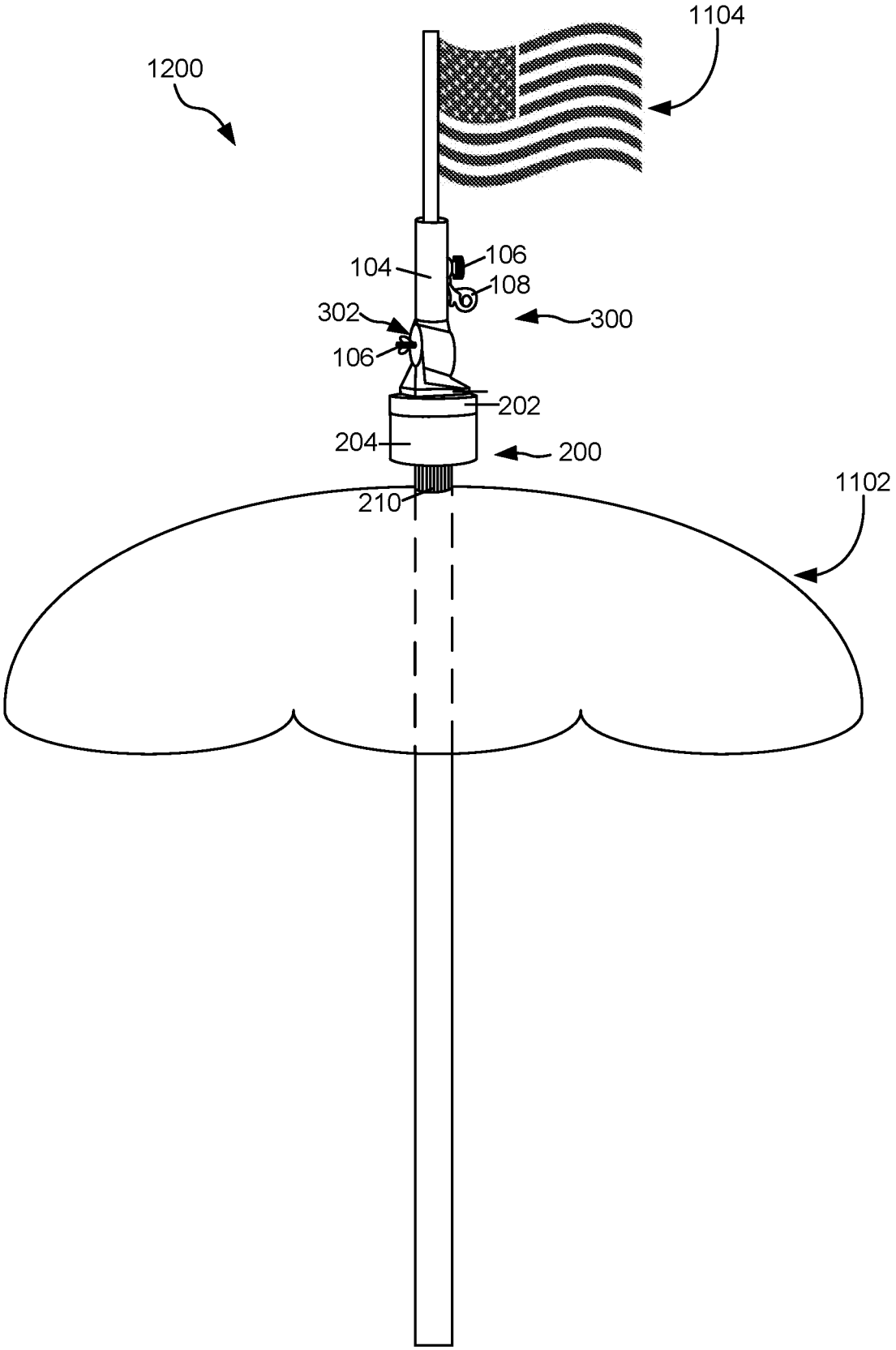
FIG. 12 is a system, according to one embodiment.

FIG. 12 depicts a system 1200, in accordance with one embodiment. As an option, the present system 1200 may be implemented in conjunction with features from any other embodiment listed herein, such as those described with reference to the other FIGS. Of course, however, such system 1200 and others presented herein may be used in various applications and/or in permutations which may or may not be specifically described in the illustrative embodiments listed herein. Further, the system 1200 presented herein may be used in any desired environment.

As shown in FIG. 12, system 1200 comprises an umbrella 1102. The umbrella may be any patio umbrella, beach umbrella, portable umbrella, umbrella canopy, awning, bungalow, cabana, tent, canopy, cover, cantilever umbrella, chair umbrella, commercial umbrella, market umbrella, industrial umbrella, erectable and/or collapsible shelter, folding canopy, gazebo, sports umbrella, hand umbrella, hut, utility shelter, parasol, sunshade, or any other umbrella, canopy, and/or supporting surfaces known in the art.

System 1200 comprises an accessory topper 1104. The accessory topper 1104 is positioned above the umbrella 1102 by a topper pole support coupled to an adapter (e.g., as shown, accessory flagpole bracket device 300 secured by a bottom portion 204 of an accessory cylindrical two-piece affixing device 200). The pole portion of the accessory topper 1104 is secured by the combination of the vertical tube 104 and at least one anchoring thumb screw fastener 106.

Figure 13:
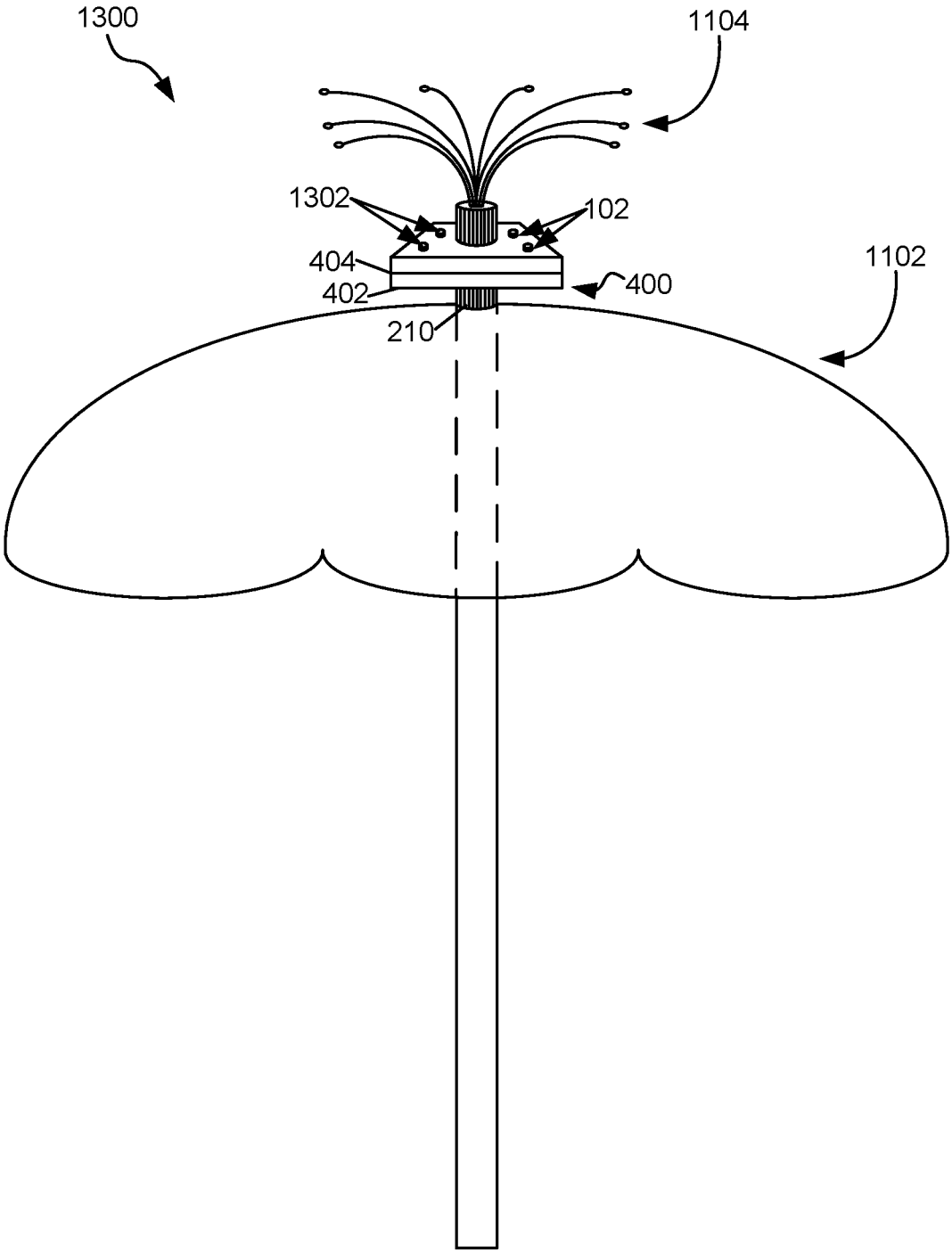
FIG. 13 is a system, according to one embodiment.

FIG. 13 depicts a system 1300, in accordance with one embodiment. As an option, the present system 1300 may be implemented in conjunction with features from any other embodiment listed herein, such as those described with reference to the other FIGS. Of course, however, such system 1300 and others presented herein may be used in various applications and/or in permutations which may or may not be specifically described in the illustrative embodiments listed herein. Further, the system 1300 presented herein may be used in any desired environment.

As shown in FIG. 13, system 1300 comprises an umbrella 1102. The umbrella may be any patio umbrella, beach umbrella, portable umbrella, umbrella canopy, awning, bungalow, cabana, tent, canopy, cover, cantilever umbrella, chair umbrella, commercial umbrella, market umbrella, industrial umbrella, erectable and/or collapsible shelter, folding canopy, gazebo, sports umbrella, hand umbrella, hut, utility shelter, parasol, sunshade, or any other umbrella, canopy, and/or supporting surfaces known in the art.

System 1300 comprises an accessory topper 1104. The accessory topper 1104 is positioned above the umbrella 1102 by a topper flat base support (e.g., as shown, accessory flat one-piece affixing device 400). The base portion of the accessory topper 1104 is secured to the accessory flat one-piece affixing device 400 via fastening mechanisms 1302 configured for use with the fastening apertures 102. Fastening mechanisms 1302 may include any anchoring thumb screw fasteners 106, clip fasteners 108, screw on/off threads 206, male threaded connectors 208, female threaded connectors 210, umbrella fasteners 502, topper fastener 504, push button clip inserts 506, locking joint 602, locking tab 604, indented hooks, screws, bolts, adhesives, nails, washers, bolts, eyes, tabs, hinges, hooks, extremities, rivets, pop rivets, pins, clips, buckles, spring snap links, carabiners, clamps, etc., or any variety of fastening mechanisms described herein, or known in the art. Fastening mechanisms may be removable or permanently integrated as part of a umbrella and/or accessory topper.

Figure 14A:
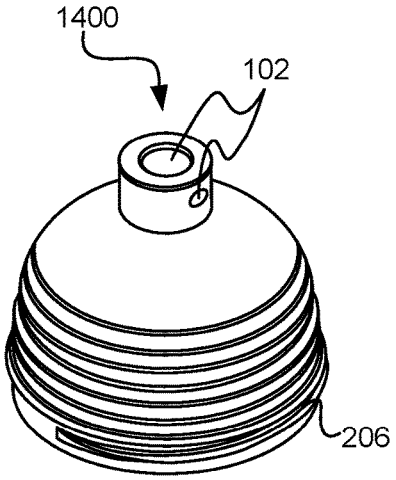
FIG. 14A is a perspective view of an adapter, according to one embodiment.

FIG. 14A is a perspective view of an adapter 1400, in accordance with one embodiment. As an option, the adapter 1400 may be implemented in conjunction with features from any other embodiment listed herein, such as those described with reference to the other FIGS. Of course, however, such adapter 1400 and others presented herein may be used in various applications and/or in permutations which may or may not be specifically described in the illustrative embodiments listed herein. Further, the adapter 1400 presented herein may be used in any desired environment.

In various approaches, the adapter 1400 may be interchangeable and/or compatible with any topper support and/or accessory topper. The adapter 1400 may be configured to position the accessory topper within, at, on, above, etc., an umbrella. The adapter 1400 may be non-permanent (e.g., removable) in some embodiments. In other embodiments, the adapter 1400 may be permanently integrated as part of the umbrella and/or accessory topper.

The adapter 1400 may comprise any rigid and/or pliable material known in the art. Exemplary materials may include any metal, plastic, rubber, material which may bent, molded, formed, shaped, etc., to securely affix any accessory topper as described herein to an umbrella.

The adapter 1400 comprises any fastening mechanisms described herein, or known in the art, for securing the adapter 1400 to an adapter base 1600 (to be described in detail below) and vice versa. In a preferred embodiment, the adapter 1400 is configured to fasten to the adapter base 1600 via counterpart screw on/off threads 206. The adapter 1400 may comprise one or more fastening apertures 102 for fastening an accessory topper with any fastening mechanism described herein, or known in the art.

In various approaches, the adapter 1400 may comprise at least one anchoring thumb screw fastener 106 (not shown). The anchoring thumb screw fastener 106 may be of any type known in the art. The anchoring thumb screw fastener 106 may include any combination of screws, nails, washers, nuts, bolts, hooks, eyes, etc. The anchoring thumb screw fastener 106 may be configured to secure (e.g., anchor) any accessory topper as described herein. In a preferred approach, the anchoring thumb screw fastener 106 secures a pole support for an accessory topper. For example, the anchoring thumb screw fastener 106 may be for securing a flag accessory topper.

Figure 14B:
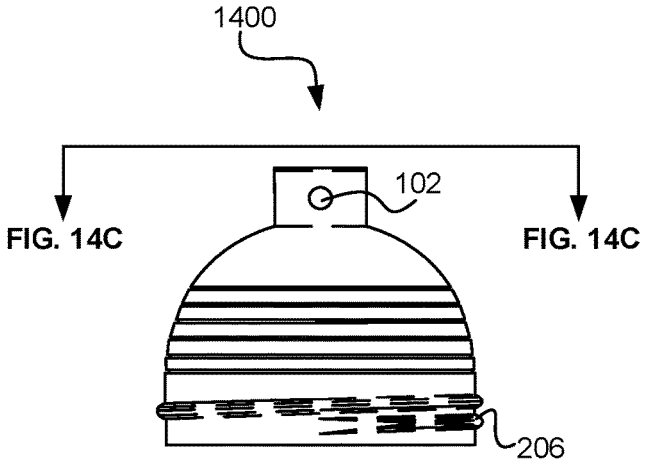
FIG. 14B is a top view of an adapter, according to one embodiment.
Figure 14C:
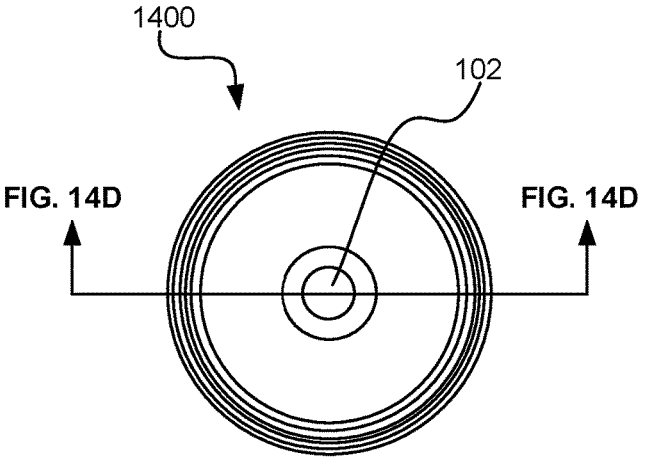
FIG. 14C is a side view of an adapter, according to one embodiment.
Figure 14D:
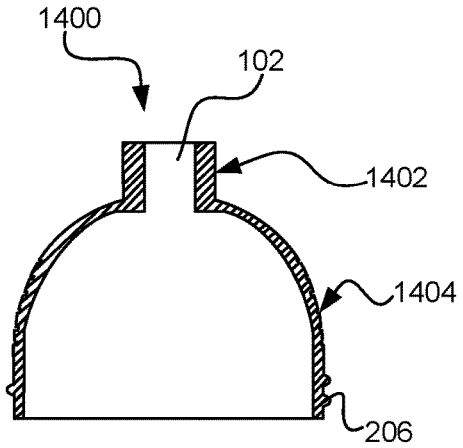
FIG. 14D is a cross-sectional side view of an adapter, according to one embodiment.

FIG. 14B is a side view of an adapter 1400, in accordance with one embodiment. FIG. 14C is a top view along the line shown in FIG. 14B. FIG. 14D is a cross-sectional side view along the line shown in FIG. 14C. As shown in FIGS. 14A-14D, adapter 1400 may comprise at least one fastening aperture 102 and screw on/off threads 206 configured to fasten the adapter 1400 to an adapter base 1600 (to be described in detail below) and vice versa.

As shown, the adapter 1400 comprises a receiving portion 1402. In preferred embodiments, the receiving portion 1402 is configured to receive and secure a pole portion of an accessory topper. The pole portion of an accessory topper may be secured in the receiving portion 1402 by an anchoring thumb screw fastener 106 (not shown) or any other fastening mechanisms 1302 described herein, or known in the art. In other preferred embodiments, the receiving portion 1402 of the adapter 1400 is configured to receive and secure a base portion of an accessory topper. The accessory topper may be secured onto the receiving portion 1402 by an aperture in the base portion (not shown) of the accessory topper 1104 coupled by a fitted snap on/off fastening onto the receiving portion 1402 (not shown) of the adapter 1500.

As shown, the adapter 1400 comprises substantially dome-shaped sidewalls 1404. Such dome-shaped sidewalls 1404 may be configured to enclose a conventional umbrella top end pole cap (e.g., any conventional ball, tip, finial, ferrule, etc.) and/or any fastening mechanism (not shown) such as any combination of screws, nails, washers, nuts, bolts, etc., which may be used to secure an adapter base 1600 (to be described in detail below) to an upper end of an umbrella. It should be understood by one having ordinary skill in the art that the sidewalls of the adapter 1400 may be any shape, size, and/or configuration.

Figure 15A:
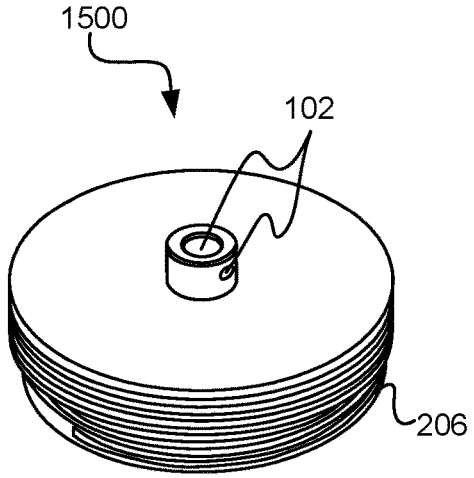
FIG. 15A is a perspective view of an adapter, according to one embodiment.

FIG. 15A is a perspective view of an adapter 1500, in accordance with one embodiment. As an option, the adapter 1500 may be implemented in conjunction with features from any other embodiment listed herein, such as those described with reference to the other FIGS. Of course, however, such adapter 1500 and others presented herein may be used in various applications and/or in permutations which may or may not be specifically described in the illustrative embodiments listed herein. Further, the adapter 1500 presented herein may be used in any desired environment.

In various approaches, the adapter 1500 may be interchangeable and/or compatible with any topper support and/or accessory topper. The adapter 1500 may be configured to position the accessory topper within, at, on, above, etc., an umbrella. The adapter 1500 may be non-permanent (e.g., removable) in some embodiments. In other embodiments, the adapter 1500 may be integrated as a permanent part of the umbrella and/or accessory topper.

The adapter 1500 may comprise any rigid and/or pliable material known in the art. Exemplary materials may include any metal, plastic, rubber, material which may bent, molded, formed, shaped, etc., to securely affix any accessory topper as described herein to an umbrella.

The adapter 1500 comprises any fastening mechanisms described herein and/or known in the art for securing the adapter 1500 to an adapter base 1600 (to be described in detail below) and vice versa. In a preferred embodiment, the adapter 1500 is configured to fasten to the adapter base 1600 via counterpart screw on/off threads 206 or any other fastening mechanism described herein, or known in the art. The adapter 1500 may comprise one or more fastening apertures 102 for fastening an accessory topper with any fastening mechanisms described herein including screw, bolts, adhesives, etc.

In various approaches, the adapter 1500 may comprise at least one anchoring thumb screw fastener 106 (not shown). The anchoring thumb screw fastener 106 may be of any type known in the art. The anchoring thumb screw fastener 106 may include any combination of screws, nails, washers, nuts, bolts, hooks, eyes, etc. The anchoring thumb screw fastener 106 may be configured to secure (e.g., anchor) any accessory topper as described herein. In a preferred approach, the anchoring thumb screw fastener 106 secures a pole support for an accessory topper. For example, the anchoring thumb screw fastener 106 may be for securing a flag accessory topper.

Figure 15B:
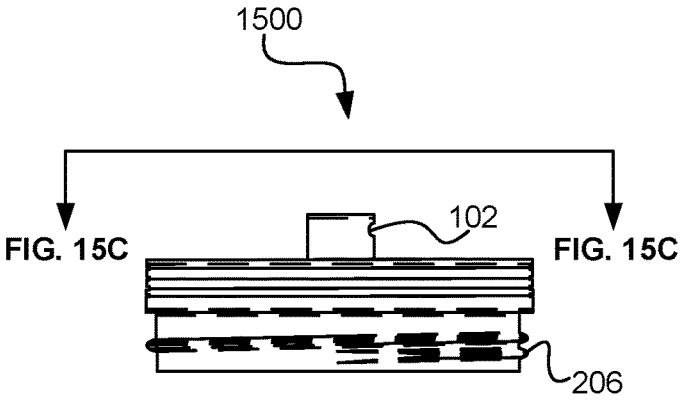
FIG. 15B is a side view of an adapter, according to one embodiment.
Figure 15C:
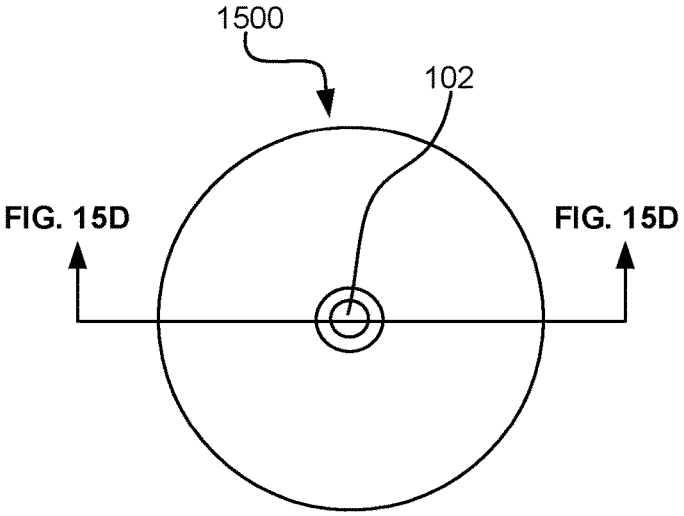
FIG. 15C is a top view of an adapter, according to one embodiment.
Figure 15D:
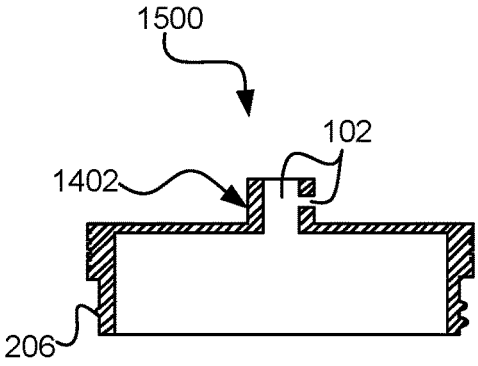
FIG. 15D is a cross-sectional side view of an adapter, according to one embodiment.

FIG. 15B is a side view of an adapter 1500, in accordance with one embodiment. FIG. 15C is a top view along the line shown in FIG. 15B. FIG. 15D is a cross-sectional side view along the line shown in FIG. 15C. As shown in FIGS. 15A-15D, adapter 1500 may comprise at least one fastening aperture 102 and screw on/off threads 206 configured to fasten the adapter 1500 to an adapter base 1600 (to be described in detail below) and vice versa.

As shown, the adapter 1500 comprises a receiving portion 1402. In preferred embodiments, the receiving portion 1402 is configured to receive and secure a pole portion of an accessory. The accessory topper may be secured in the receiving portion 1402 by an anchoring thumb screw fastener 106 (not shown) or any other fastening mechanisms 1302 described herein and/or known in the art. In other preferred embodiments, the receiving portion 1402 of the adapter 1500 is configured to receive and secure a base portion of an accessory topper. The accessory topper may be secured onto the receiving portion 1402 by an aperture in the base portion (not shown) of the accessory topper 1104 coupled by a fitted snap on/off fastening onto the receiving portion 1402 (not shown) of the adapter 1500.

As shown, the adapter 1500 comprises substantially vertical sidewalls with a flat top surface. Such vertical sidewalls with a flat top surface may be configured to enclose a substantially flat conventional umbrella top end pole cap and/or any fastening mechanism, such as any combination of screws, nails, washers, nuts, bolts, etc., which may be used to secure an adapter base 1600 (to be described in detail below) to an upper end of an umbrella. It should be understood by one having ordinary skill in the art that the sidewalls of the adapter 1500 may be any shape, size and/or configuration.

Figure 16A:
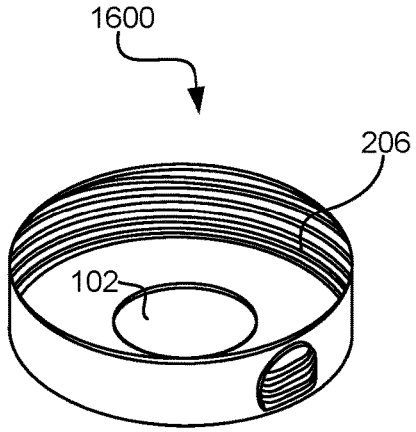
FIG. 16A is a perspective view of an adapter base, according to one embodiment.

FIG. 16A is a perspective view of an adapter base 1600, in accordance with one embodiment. As an option, the adapter base 1600 may be implemented in conjunction with features from any other embodiment listed herein, such as those described with reference to the other FIGS. Of course, however, such adapter base 1600 and others presented herein may be used in various applications and/or in permutations which may or may not be specifically described in the illustrative embodiments listed herein. Further, the adapter base 1600 presented herein may be used in any desired environment.

In various approaches, the adapter base 1600 may be interchangeable and/or compatible with any topper support and/or accessory topper. The adapter base 1600 may be configured to position the accessory topper within, at, on, above, etc., an umbrella. The adapter base 1600 may be non-permanent (e.g., removable) in some embodiments. In other embodiments, the adapter base 1600 may be permanently integrated as part of the umbrella and/or accessory topper.

The adapter base 1600 may comprise any rigid and/or pliable material known in the art. Exemplary materials may include any metal, plastic, rubber, material which may bent, molded, formed, shaped, etc., to securely affix any accessory topper as described herein to an umbrella.

The adapter base 1600 comprises any fastening mechanisms described herein for securing the adapter base 1600 to an adapter (e.g., adapter 1400, adapter 1500, etc.) and vice versa. In a preferred embodiment, the adapter base 1600 is configured to fasten to the adapter (e.g., adapter 1400, adapter 1500, etc.) via counterpart screw on/off threads 206. The adapter base 1600 may comprise one or more fastening apertures 102 for fastening an accessory topper with any fastening mechanisms described herein including screw, bolts, adhesives, etc., or any fastening mechanisms known in the art.

In various embodiments, the fastening aperture 102 may be positioned around an exterior male or interior female threaded umbrella fastener 502 of the umbrella components. In one approach, a conventional umbrella top end pole cap 1106 may fasten to the umbrella fastener 502 via screw on/off threads 206. In some approaches, In one approach, a conventional umbrella top end pole cap 1106 may fasten to the upper end of the umbrella pole shaft support, the umbrella upper stationary hub support, etc., and securely affixed between screw on/off threads of the exterior male or interior female threaded umbrella fastener and the male/female counterpart screw on/off threads of a conventional umbrella top end pole cap 1106 to secure the adapter base 1600 to an umbrella. In preferred embodiments, the adapter (e.g., adapter 1400, adapter 1500, etc.) may be fastened to the adapter base 1600. The adapter (e.g., adapter 1400, adapter 1500, etc.) may be operatively coupled to the umbrella using any fastening mechanism securing the adapter base 1600 via the fastening aperture 102 of the adapter base 1600.

It should be understood that the adapter base 1600 may comprise any fastening mechanisms described in the present disclosure, or known in the art.

Figure 16B:
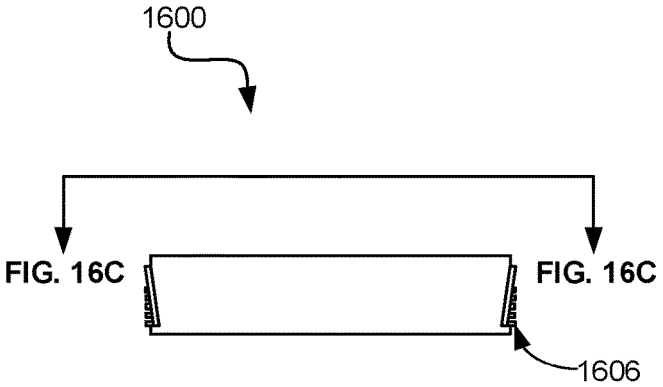
FIG. 16B is a side view of an adapter base, according to one embodiment.
Figure 16C:
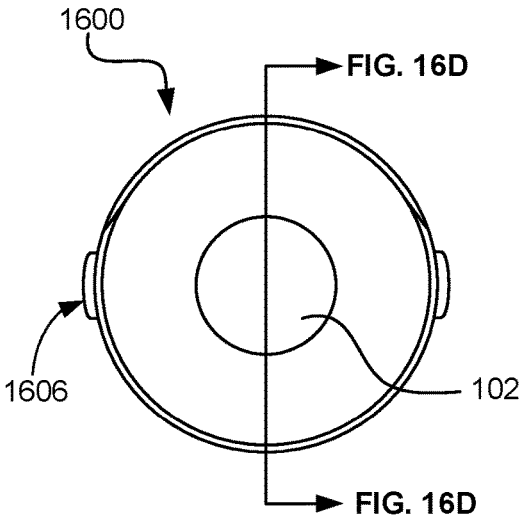
FIG. 16C is a top view of an adapter base, according to one embodiment.
Figure 16D:
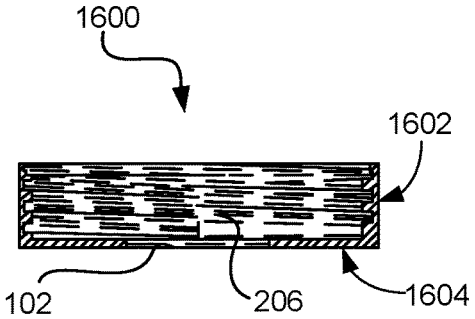

FIG. 16B is a side view of an adapter base 1600, in accordance with one embodiment. FIG. 16C is a top view along the line shown in FIG. 16B. FIG. 16D is a cross-sectional side view along the line shown in FIG. 16C. As shown in FIGS. 16A-16D, adapter base 1600 may comprise at least one fastening aperture 102 and screw on/off threads 206 configured to fasten the adapter base 1600 to an adapter (e.g., adapter 1400, adapter 1500, etc.) and vice versa.

As shown, the adapter base 1600 comprises a peripheral section 1602 extending from a bottom 1604 of the adapter base 1600. In some embodiments, the peripheral section 1602 may comprise textured grooves 1606 to assist a user to couple and/or decouple the adapter base 1600 from an adapter 1400, adapter 1500, an upper end of an umbrella, etc. In some approaches, the bottom 1604 is a substantially flat surface and may be any shape, size, and/or configuration.

It should be understood by one having ordinary skill in the art upon reading the present disclosure that an adapter may comprise a top portion and a bottom portion opposite the top portion. In various approaches, adapter 1400 and/or adapter 1500 may be considered a top portion of an adapter and the adapter base 1600 may be considered a bottom portion of an adapter. The top portion of the adapter may be positioned above the bottom portion when the top portion is coupled to a topper support and/or an accessory topper. The bottom portion of the adapter may be configured for operative coupled to an upper end of the umbrella. In other embodiments, adapter 1400 and/or adapter 1500 and the adapter base 1600 may be permanently integrated as part of the umbrella and/or accessory topper.

Figure 17:
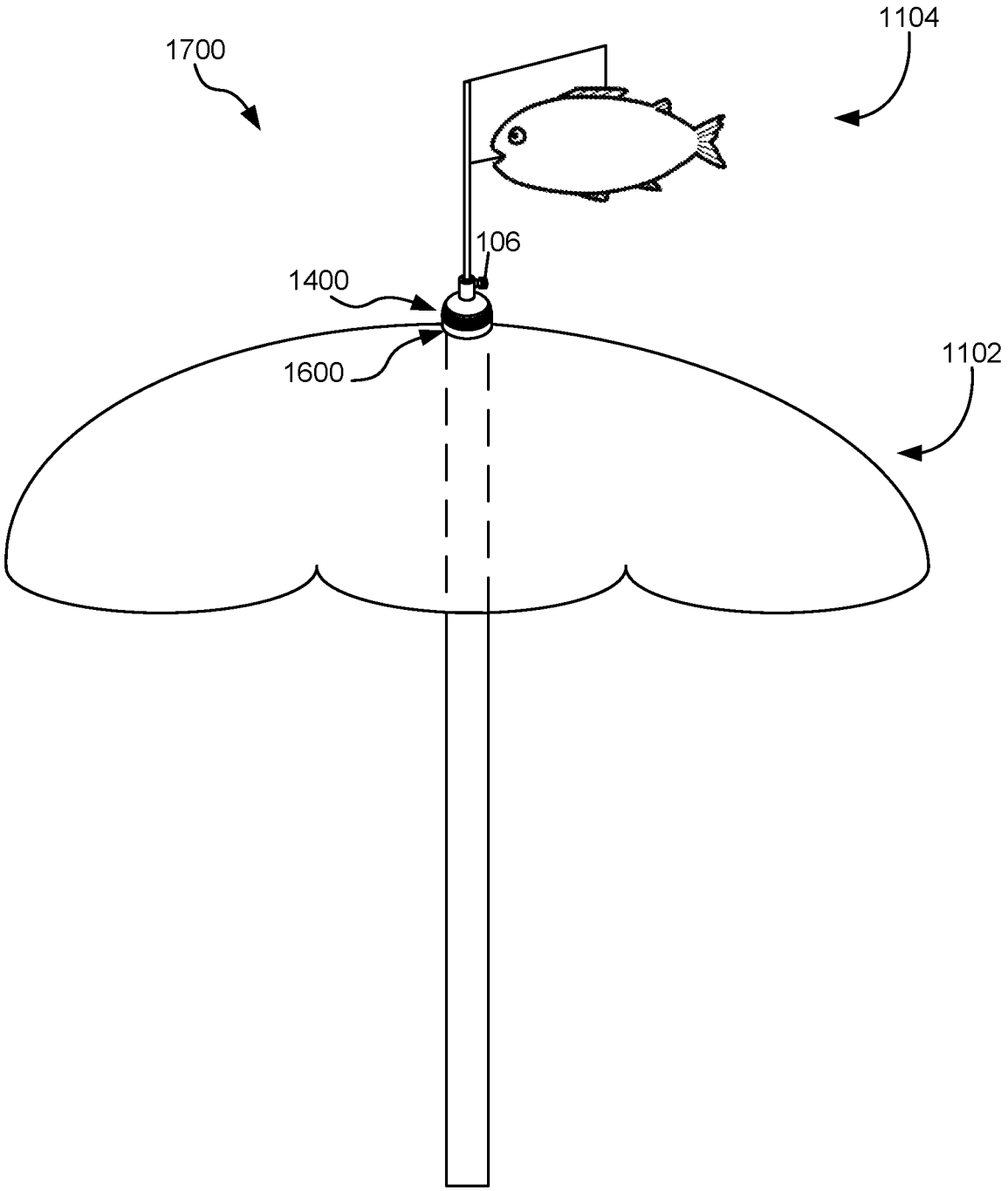
FIG. 17 is a system, according to one embodiment.

FIG. 17 depicts a system 1700, in accordance with one embodiment. As an option, the present system 1700 may be implemented in conjunction with features from any other embodiment listed herein, such as those described with reference to the other FIGS. Of course, however, such system 1700 and others presented herein may be used in various applications and/or in permutations which may or may not be specifically described in the illustrative embodiments listed herein. Further, the system 1700 presented herein may be used in any desired environment.

As shown in FIG. 17, system 1700 comprises an umbrella 1102. The umbrella may be any patio umbrella, beach umbrella, portable umbrella, umbrella canopy, awning, bungalow, cabana, tent, canopy, cover, cantilever umbrella, chair umbrella, commercial umbrella, market umbrella, industrial umbrella, erectable and/or collapsible shelter, folding canopy, gazebo, sports umbrella, hand umbrella, hut, utility shelter, parasol, sunshade, or any other umbrella, canopy, and/or supporting surfaces known in the art.

System 1700 comprises an accessory topper 1104. The accessory topper 1104 is positioned above the umbrella 1102 by an adapter 1400 fastened to an adapter base 1600. The pole portion of the accessory topper 1104 may be secured by the adapter 1400 comprising at least one anchoring thumb screw fastener 106. In various embodiments, a string portion of an accessory topper 1104 may be secured by an anchoring thumb screw fastener 106 and/or a clip fastener 108 (not shown). The adapter base 1600 may be operatively coupled to the umbrella 1102 via a fastening aperture 102 (not shown) and/or any fastening mechanism describe herein and/or known in the art.

Figure 18:
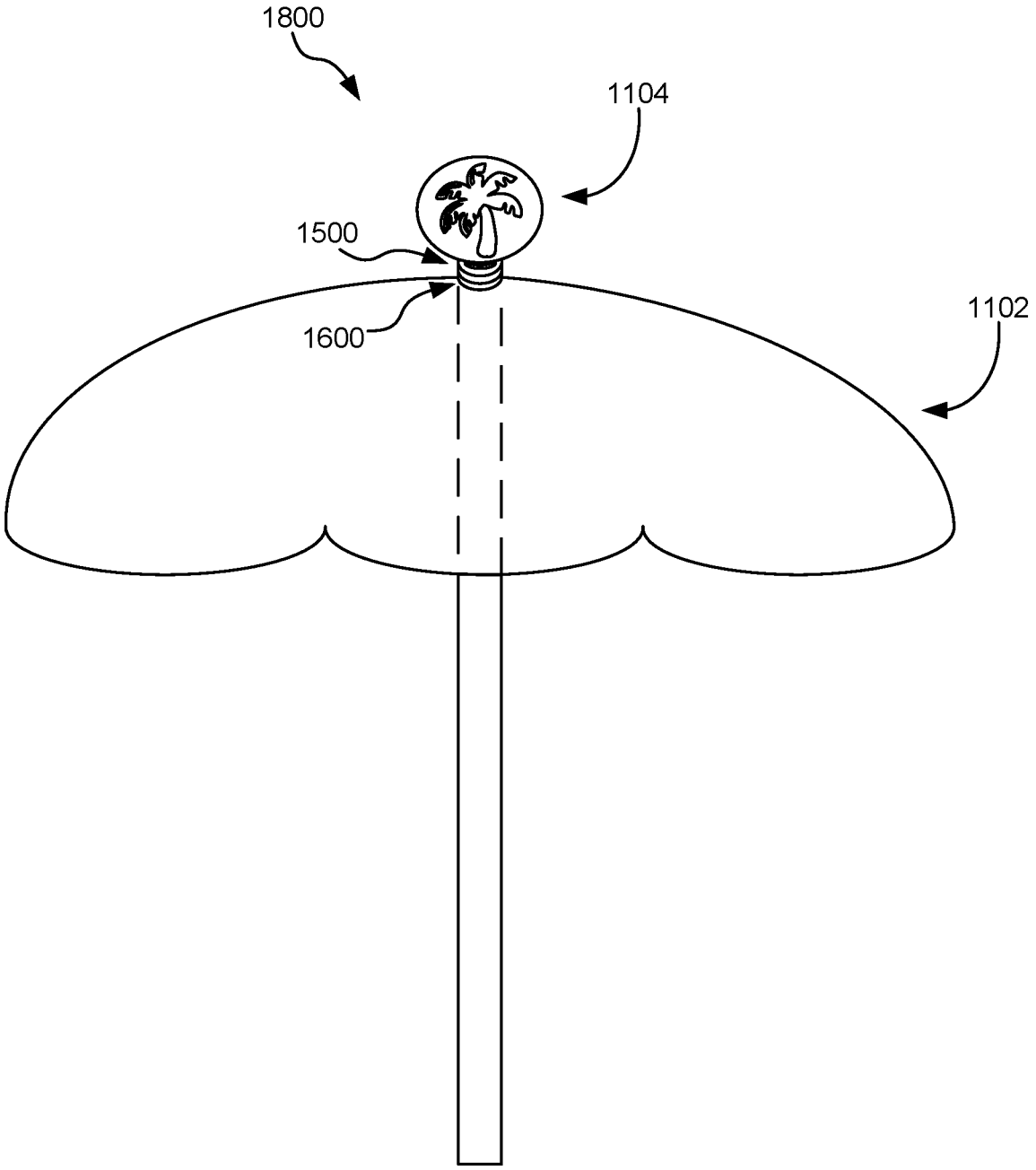
FIG. 18 is a system, according to one embodiment.

FIG. 18 depicts a system 1800, in accordance with one embodiment. As an option, the present system 1800 may be implemented in conjunction with features from any other embodiment listed herein, such as those described with reference to the other FIGS. Of course, however, such system 1800 and others presented herein may be used in various applications and/or in permutations which may or may not be specifically described in the illustrative embodiments listed herein. Further, the system 1800 presented herein may be used in any desired environment.

As shown in FIG. 18, system 1800 comprises an umbrella 1102. The umbrella may be any patio umbrella, beach umbrella, portable umbrella, umbrella canopy, awning, bungalow, cabana, tent, canopy, cover, cantilever umbrella, chair umbrella, commercial umbrella, market umbrella, industrial umbrella, erectable and/or collapsible shelter, folding canopy, gazebo, sports umbrella, hand umbrella, hut, utility shelter, parasol, sunshade, or any other umbrella, canopy, and/or supporting surfaces known in the art.

System 1800 comprises an accessory topper 1104 (e.g., a solar light globe). The accessory topper 1104 is positioned above the umbrella 1102 by an adapter 1500 fastened to an adapter base 1600. In preferred embodiments, the accessory topper 1104 is configured to fasten to the adapter 1500 via an aperture 102 in the base portion (not shown) of an accessory topper 1104 coupled by a fitted snap on/off fastening mechanism onto the receiving portion 1402 (not shown) of the adapter 1500. In preferred embodiments, the pole support of an accessory topper 1104 may be configured to fasten to the adapter 1500 via an anchoring thumb screw fastener 106. In another embodiment, the accessory topper 1104 may be configured to fasten to the adapter 1500 via counterpart screw on/off threads 206 or any other fastening mechanisms described herein and/or known in the art. The adapter base 1600 may be operatively coupled to the umbrella 1102 via a fastening aperture 102 (not shown) and any fastening mechanism describe herein (not shown) or known in the art.

Fastening mechanisms for any of the embodiments described above may include fastening apertures 102, anchoring thumb screw fasteners 106, clip fasteners 108, screw on/off threads 206, male threaded connectors 208, female threaded connectors 210, umbrella fasteners 502, topper fastener 504, push button clip inserts 506, locking joint 602, locking tab 604, indented hooks, screws, bolts, adhesives, nails, washers, bolts, eyes, tabs, hinges, hooks, extremities, rivets, pop rivets, pins, clips, buckles, spring snap links, carabiners, clamps, magnetics, touch and close fasteners, textiles, etc., or any fastening mechanisms described herein, or known in the art. In some approaches, the standard umbrella end cap comprising screw on/off threads 206 may be used to secure a topper support, accessory topper, and/or adapter via a fastening aperture 102.

Fastening mechanisms for any of the embodiments described above may include mating relationships as would be understood by one having ordinary skill in the art. A mating relationship may comprise a counterpart screw on/off threads 206, male threaded connectors 208 to female threaded connectors 210 and vice versa, male/female push button clip inserts 506 configured for use with male/female fastening apertures 102, locking joint 602 configured for use with locking tab 604, etc., or counterpart fastening mechanisms known in the art.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A system, comprising:

a topper support having a first end and a second end opposite the first end, wherein the first end of the topper support is configured for operative coupling to an upper end of an umbrella, whereby the second end is positioned above the upper end of the umbrella when the first end is coupled to the upper end of the umbrella, wherein the second end of the topper support is configured for operative coupling to an accessory topper, wherein the second end of the topper support is configured for operatively coupling to a second topper support, wherein the second topper support comprises a first section and a second section opposite the first section, wherein the second section of the second topper support is configured for operative coupling to the accessory topper.

2. The system of claim 1, comprising the umbrella.

3. The system of claim 2, wherein the umbrella is an erectable and collapsible structure comprising a plurality of supporting structures and a shade.

4. The system of claim 1, comprising the accessory topper.

5. The system of claim 4, wherein the topper support is a topper pole support, wherein the accessory topper comprises a pole configured for operative coupling into the topper pole support.

6. The system of claim 4, wherein the accessory topper is detachably coupled to the second end of the topper support.

7. A system, comprising:

a topper support having a first end and a second end opposite the first end, wherein the first end of the topper support is configured for operative coupling to an upper end of an umbrella, whereby the second end is positioned above the upper end of the umbrella when the first end is coupled to the upper end of the umbrella, wherein the second end of the topper support is configured for operative coupling to an accessory topper, wherein the first end of the topper support is configured for direct coupling to an adapter, wherein the adapter is configured for direct coupling to the upper end of the umbrella, wherein the adapter is a two-piece affixing device comprising a top portion and a bottom portion.

8. The system of claim 7, wherein the second end of the topper support is configured for operatively coupling to a second topper support.

9. The system of claim 8, wherein the second topper support comprises a first section and a second section opposite the first section, wherein the second section of the second topper support is configured for operative coupling to the accessory topper.

10. The system of claim 7, comprising the accessory topper.

11. The system of claim 10, wherein the topper support is a topper pole support, wherein the accessory topper comprises a pole configured for operative coupling into the topper pole support.

12. The system of claim 7, wherein the umbrella is an erectable and collapsible structure comprising a plurality of supporting structures and a shade.

13. A system, comprising:

a topper support having a first end and a second end opposite the first end, wherein the first end of the topper support is configured for operative coupling to an upper end of an umbrella, whereby the second end is positioned above the upper end of the umbrella when the first end is coupled to the upper end of the umbrella, wherein the second end of the topper support is configured for operative coupling to an accessory topper, wherein the first end of the topper support is configured for direct coupling to an interface connector, wherein the interface connector is configured for direct coupling to the upper end of the umbrella, wherein the interface connector is a single piece affixing device comprising at least one push button clip insert and screw on/off threads opposite the at least one push button clip.

14. The system of claim 13, comprising the accessory topper.

15. The system of claim 11, wherein the topper support is a topper pole support, wherein the accessory topper comprises a pole configured for operative coupling into the topper pole support.

16. A system, comprising:

an umbrella;

a topper support having a first end and a second end opposite the first end; and an adapter having a top portion and a bottom portion opposite the top portion, wherein the top portion is positioned above the bottom portion when the top portion is coupled to the topper support, wherein the top portion comprises a substantially flat surface having a fastening mechanism configured for coupling to the topper support, wherein the bottom portion of the adapter is configured for operative coupling to an upper end of the umbrella, wherein the first end of the topper support is configured for operative coupling to the top portion of the adapter, wherein the second end of the topper support is configured for operative coupling to an accessory topper, wherein the second end of the topper support is pivotable away from a longitudinal axis of the umbrella.

17. The system of claim 16, wherein the top portion is detachably coupled to the bottom portion.

18. The system of claim 16, wherein the bottom portion is configured for operative coupling to a second topper support.

19. The system of claim 16, wherein the top portion is configured for operative coupling to an accessory topper.

20. The system of claim 16, comprising the accessory topper.

21. The system of claim 20, wherein the topper support is a topper pole support, wherein the accessory topper comprises a pole configured for operative coupling into the topper pole support.

22. The system of claim 20, wherein the accessory topper is detachably coupled to the second end of the topper support and/or the adapter.

23. The system of claim 20, wherein the adapter is integrated as a permanent component of the accessory topper.

24. The system of claim 20, wherein the adapter is integrated as a permanent component of the umbrella.

25. The system of claim 20, wherein the accessory topper is detachably coupled to the umbrella and/or the adapter.

26. A system, comprising:

a topper support having a first end and a second end opposite the first end, wherein the first end of the topper support is configured for operative coupling to an upper end of an umbrella, whereby the second end is positioned above the upper end of the umbrella when the first end is coupled to the upper end of the umbrella, wherein the second end of the topper support is configured for operative coupling to an accessory topper, wherein the topper support is pivotable away from a longitudinal axis of the umbrella.

27. A system, comprising:

an accessory topper; and a topper support having a first end and a second end opposite the first end, wherein the first end of the topper support is configured for operative coupling to an upper end of an umbrella, whereby the second end is positioned above the upper end of the umbrella when the first end is coupled to the upper end of the umbrella, wherein the second end of the topper support is configured for operative coupling to the accessory topper, wherein the topper support is a topper pole support, wherein the accessory topper comprises a pole configured for operative coupling into the topper pole support, wherein the accessory topper includes a first portion which extends above the upper end of the topper support and a second portion which extends substantially above the first portion and substantially across an axis which is perpendicular to an axis of the umbrella.

28. A system, comprising:

an umbrella; and a topper support having a first end and a second end opposite the first end, wherein the first end of the topper support is configured for operative coupling to an upper end of the umbrella, whereby the second end is positioned above the upper end of the umbrella when the first end is coupled to the upper end of the umbrella, wherein the second end of the topper support is configured for operative coupling to an accessory topper, wherein the first end of the topper support is configured for direct coupling to an adapter, wherein the adapter is configured for direct coupling to the upper end of the umbrella, wherein the adapter is a two-piece affixing device comprising a top portion and a bottom portion, wherein the first end of the topper support is directly coupled to the adapter, wherein the adapter is directly coupled to the upper end of the umbrella.

29. The system of claim 28, comprising the accessory topper.

30. The system of claim 29, wherein the topper support is a topper pole support, wherein the accessory topper comprises a pole configured for operative coupling into the topper pole support.

31. The system of claim 28, comprising the adapter.

32. The system of claim 31, wherein the adapter is integrated as a permanent component of the accessory topper.

33. The system of claim 31, wherein the adapter is integrated as a permanent component of the umbrella.

34. The system of claim 31, wherein the accessory topper is detachably coupled to the umbrella and/or the adapter.

35. A system, comprising:

an umbrella; and a topper support having a first end and a second end opposite the first end, wherein the first end of the topper support is configured for operative coupling to an upper end of the umbrella, whereby the second end is positioned above the upper end of the umbrella when the first end is coupled to the upper end of the umbrella, wherein the second end of the topper support is configured for operative coupling to an accessory topper, wherein the first end of the topper support is configured for direct coupling to an interface connector, wherein the interface connector is configured for direct coupling to the upper end of the umbrella, wherein the interface connector is a single piece affixing device comprising at least one push button clip insert and screw on/off threads opposite the at least one push button clip, wherein the first end of the topper support is directly coupled coupling to an interface connector, wherein the interface connector is directly coupled to the upper end of the umbrella.

36. The system of claim 35, comprising the accessory topper.

37. The system of claim 36, wherein the topper support is a topper pole support, wherein the accessory topper comprises a pole configured for operative coupling into the topper pole support.

* * * * *